US006586714B2

(12) United States Patent
Kawamura et al.

(10) Patent No.: US 6,586,714 B2
(45) Date of Patent: Jul. 1, 2003

(54) MICROWAVE OVEN CAPABLE OF SUITABLY CONTROLLING MOVEMENT OF A MEMBER MOUNTED THERETO, AND CONTROL METHOD THEREOF

(75) Inventors: Kazuhiko Kawamura, Otsu (JP); Hiroyuki Uehashi, Koga-gun (JP); Masaru Noda, Koga-gun (JP); Eiji Fukunaga, Otsu (JP); Kazuo Taino, Koga-gun (JP)

(73) Assignee: Sanyo Electric Co., Ltd., Osaka (JP)

( * ) Notice: Subject to any disclaimer, the term of this patent is extended or adjusted under 35 U.S.C. 154(b) by 117 days.

(21) Appl. No.: 09/791,820

(22) Filed: Feb. 26, 2001

(65) Prior Publication Data

US 2001/0019054 A1 Sep. 6, 2001

(30) Foreign Application Priority Data

Feb. 29, 2000 (JP) ..... 2000-053686

(51) Int. Cl.[7] ..... H05B 6/68

(52) U.S. Cl. ..... 219/711; 219/754; 219/494; 374/149; 99/325

(58) Field of Search ..... 219/710, 711, 219/494, 510, 720, 702, 754, 506; 374/149, 121; 99/325

(56) References Cited

U.S. PATENT DOCUMENTS 5,609,786 A * 3/1997 An ..... 219/702
5,693,247 A 12/1997 Bu et al. ..... 219/711
5,932,130 A * 8/1999 Taino ..... 219/702
5,986,249 A * 11/1999 Yoshino et al. ..... 219/746
6,132,084 A * 10/2000 Whipple, III et al. ..... 219/711

FOREIGN PATENT DOCUMENTS

| | | | | |
|---|---|---|---|---|
| EP | 0 781 072 A1 | | 6/1997 | |
| GB | 2 001 166 A | | 1/1979 | |
| JP | 56-10633 | * | 2/1981 | ..... 219/711 |
| JP | 6-201137 | * | 7/1994 | ..... 219/710 |
| JP | 8-145376 | | 6/1996 | |
| JP | 8-339545 | | 12/1996 | |
| JP | 9-72549 | | 3/1997 | |

OTHER PUBLICATIONS

Abstract of JP 2000 337639.

Abstract of JP 6193883.

* cited by examiner

*Primary Examiner*—Philip H. Leung
(74) *Attorney, Agent, or Firm*—Armstrong, Westerman & Hattori, LLP

(57) ABSTRACT

The microwave oven includes an infrared sensor for detecting the temperature of a food within a heating chamber. The infrared sensor has a field of view within the heating chamber. The infrared sensor is capable of moving the field of view. The food is often placed in the central region of the heating chamber. Therefore, when cooking is started, the field of view of the infrared sensor first scans the central region of the heating chamber.

14 Claims, 16 Drawing Sheets

MICROWAVE OVEN CAPABLE OF SUITABLY CONTROLLING MOVEMENT OF A MEMBER MOUNTED THERETO, AND CONTROL METHOD THEREOF

BACKGROUND OF THE INVENTION

1. Field of the Invention

The present invention generally relates to a microwave oven and a control method thereof. More particularly, the present invention relates to a microwave oven with its convenience being improved by suitably controlling movement of a member mounted thereto, and a control method thereof.

2. Description of the Background Art

As described in Japanese Laid-Open Publication Nos. 8-145376 and 9-72549, some of the conventional microwave ovens are provided with an infrared sensor capable of detecting the temperature of a food within a heating chamber. Note that this infrared sensor is capable of including a part of the heating chamber in its field of view, and also capable of moving the field of view. Accordingly, wherever the food is placed in the heating chamber, the infrared sensor can include the food in the field of view, and thus can detect the temperature of the food.

However, the conventional microwave ovens move the field of view of the infrared sensor first from a corner of the heating chamber. In general, the food is often placed in the central region of the heating chamber. Therefore, cooking of the food may be completed before the food is included in the field of view of the infrared sensor. In other words, the conventional microwave ovens may not be able to use the detection result of the infrared sensor for cooking, resulting in degraded convenience.

Moreover, in order to move the field of view of the infrared sensor in such a manner as described above, the infrared sensor is conventionally moved with a motor. However, the field of view of the infrared sensor may not be able to be moved to a correct position due to the problems of such a moving mechanism itself. This will be described with reference to FIGS. 18 and 19. FIGS. 18 and 19 are diagrams illustrating the problems of the moving mechanism using a motor.

FIG. 18 is a diagram showing a gear that rotates according to operation of the motor (motor-side gear 200) and a gear that is fixed to the infrared sensor (sensor-side gear 100). The motor-side gear 200 is rotatable in the rotation direction H1 or H2. When the motor-side gear 200 is driven by the motor to rotate in the rotation direction H1, the sensor-side gear 100 rotates in the rotation direction J1 accordingly. When the motor-side gear 200 rotates in the rotation direction H2, the sensor-side gear 100 rotates in the rotation direction J2 accordingly. In response to the rotation of the sensor-side gear 100 in the rotation direction J1 or J2, the infrared sensor is moved, so that the field of view thereof is moved.

Note that the movement distance of the infrared sensor is controlled by controlling the rotation distance of the motor-side gear 200.

FIG. 19 is an enlarged view of an engaged tooth portion of the two gears shown in FIG. 18. There is a clearance B between a tooth of the motor-side gear 200 and a tooth of the sensor-side gear 100 engaged therewith. Note that the two gears are rotatable, namely, are not fixed. Accordingly, the clearance between the engaged teeth is not always constant at B. In other words, the clearance is produced only under the tooth of the sensor-side gear 100 in FIG. 19, but such a clearance may be produced both above and under the tooth of the sensor-side gear 100.

Provided that the clearance between the tooth of the motor-side gear 200 and the tooth of the sensor-side gear 100 engaged therewith is not constant, the motor-side gear 200 does not rotate by a constant distance from the start of its rotation until the rotation force thereof is transmitted to the sensor-side gear 100.

In other words, even if the rotation distance of the motor-side gear 200 is accurately controlled, the movement distance of the infrared sensor cannot be controlled accurately.

Therefore, the conventional microwave ovens may not be able to move the field of view of the infrared sensor by an accurate distance. As a result, the conventional microwave ovens may not be able to include the food within the heating chamber in the field of view of the infrared sensor, resulting in degraded convenience.

Moreover, in order to demonstrate features of the microwave oven at the stores or the like, the conventional microwave ovens have a demonstration function to rotate a turntable and display the remaining cooking time without conducting the heating operation. The conventional microwave ovens provided with the infrared sensor are capable of causing the infrared sensor to detect a temperature without conducting the heating operation as a demonstration.

However, such a demonstration of temperature detection by the infrared sensor in the conventional microwave ovens is conducted with the field of view of the infrared sensor being fixed in position. Therefore, the conventional microwave ovens cannot demonstrate the ability to detect the temperature of the food regardless of the position of the food within the heating chamber, resulting in degraded convenience.

Moreover, some of the conventional microwave ovens are provided with a rotating antenna in order to diffuse microwaves oscillated by a magnetron. This rotating antenna is rotatable. However, the conventional microwave ovens cannot rotate the rotating antenna that directly relates to the heating operation of the magnetron in the demonstration, resulting in degraded convenience.

SUMMARY OF THE INVENTION

The present invention is made in view of the above, and it is an object of the present invention to provide a microwave oven with improved convenience by causing a member for moving a field of view of an infrared sensor to move in an appropriate manner.

It is another object of the present invention to provide a microwave oven with improved convenience by causing a member for moving a field of view of an infrared sensor to move in an appropriate manner when conducting a demonstration.

It is still another object of the present invention to provide a microwave oven with improved convenience by causing a rotating antenna to move in an appropriate manner when conducting a demonstration.

According to one aspect of the present invention, a microwave oven is characterized in that it includes a heating chamber for accommodating an object, an infrared sensor having a field of view within the heating chamber, for detecting a temperature of the object in the heating chamber, and a field-of-view moving portion for moving the field of view of the infrared sensor. Note that the field-of-view moving portion moves the field of view in a central region of the heating chamber when temperature detection by the infrared sensor is started in the microwave oven.

According to the present invention, a food can be more quickly included in the field of view of the infrared sensor when being placed in the central region of the heating chamber.

In the microwave oven, the food is often placed in the central region of the heating chamber. Therefore, in such a case, the food can be more quickly included in the field of view. In other words, heating of the food is less likely to be completed before the food is included in the field of view of the infrared sensor. As a result, convenience of the microwave oven can be improved.

Preferably, the microwave oven according to the present invention further includes a presence determination portion for determining whether or not the object is present within the field of view of the infrared sensor, based on a detection result of the infrared sensor. The field-of-view moving potion preferably extends a movement range of the field of view to a range broader than the central region of the heating chamber, if the presence determination portion determines that the object is not present in the central region of the heating chamber.

As a result, the food can be included in the field of view of the infrared sensor even when being placed in a position other than the central region of the heating chamber.

Preferably, the microwave oven according to the present invention further includes a presence determination portion for determining whether or not the object is present within the field of view of the infrared sensor, based on a detection result of the infrared sensor, a heating portion for heating the object in the heating chamber, and a control portion for controlling the heating operation of the heating portion. If the presence determination portion determines that the object is not present in the central region of the heating chamber, the control portion preferably discontinues the heating operation of the heating portion right after the movement of the field of view in the central region of the heating chamber is completed, or after a predetermined time has passed since the movement of the field of view in the central region of the heating chamber is completed.

As a result, the heating can be prevented from being conducted despite the fact that no food is placed in the heating chamber.

In the microwave oven according to the present invention, the field-of-view moving portion preferably starts moving the field of view when the heating operation of the heating portion is started. When the field-of-view moving portion extends the movement range of the field of view to the range broader than the central region of the heating chamber, the control portion preferably reduces a heating output of the heating portion from a value that was used during movement of the field of view in the central region of the heating chamber. In this case, the reduced heating output is used until the presence determination portion determines that the object is present.

As a result, over-heating of the food can be prevented as much as possible when scanning of the field of view must be conducted for a long time in order to detect the position of the food. Moreover, in the case where no food is likely to be placed in the heating chamber, a wasteful heating operation can be suppressed. This is because, in the microwave oven, the food is often placed in the central region of the heating chamber.

Preferably, the microwave oven according to the present invention further includes a movement instruction portion for sending the field-of-view moving portion an instruction of whether to move the field of view or not, a movement determination portion for determining whether the field of view is being moved or not, and a notifying portion for notifying if a determination result of the movement determination portion is different from the instruction sent from the movement instruction portion to the field-of-view moving portion.

As a result, such a problematic situation of the microwave oven that the food cannot be included the field of view due to inability to control the moving manner of the field of view of the infrared sensor can be solved in an early stage.

In the microwave oven according to the present invention, the control portion preferably discontinues the heating operation of the heating portion in response to the notification from the notifying portion.

As a result, the heating portion can be prevented from continuing the heating operation in such a dangerous situation that a member of the microwave oven malfunctions.

According to another aspect of the present invention, a microwave oven is characterized in that it includes a heating chamber for accommodating an object, an infrared sensor having a field of view within the heating chamber, for detecting a temperature of the object in the heating chamber, a motor for moving the infrared sensor in order to move the field of view, a sensor-side gear fixed to the infrared sensor, and a motor-side gear fixed to the motor, and engaged with the sensor-side gear, and in that the sensor-side gear is rotatable, and is biased in one of rotation directions of the sensor-side gear.

According to the present invention, the distance between a tooth of the motor-side gear and a tooth of the sensor-side gear can be made constant.

In other words, the motor-side gear always rotates by a constant distance from the start of its rotation until the tooth thereof is brought into contact with the tooth of the sensor-side gear for power transmission thereto. Accordingly, the relation between the driving amount of the motor and the movement amount of the field of view of the infrared sensor is stabilized. As a result, the field of view of the infrared sensor can be moved more accurately.

Preferably, in the microwave oven according to the present invention, the sensor-side gear is rotatable in one and the other of the rotation directions, and a rotation limit for moving the field of view is set in each of one and the other of the rotation directions of the sensor-side gear. The rotation limit for moving the field of view is a rotation limit to which the sensor-side gear can rotate in order to move the field of view. An origin of the field of view is preferably defined as a position corresponding to the sensor-side gear rotated to the rotation limit for moving the field of view in one of the rotation directions.

Accordingly, when the field of view of the infrared sensor is located at the origin, the sensor-side gear is biased in one of the rotation directions, and located at the rotation limit in one of the rotation directions.

In other words, when the field of view is located at the origin, the tooth of the sensor-side gear is in contact with the tooth of the motor-side gear, at the surface located in one of the rotation directions of the sensor-side gear. This is because the sensor-side gear is biased in one of the rotation directions. In order to move the field of view from the origin, the sensor-side gear is rotated in the other rotation direction. Therefore, the power of the motor-side gear is transmitted to the sensor-side gear from the moment the rotation of the motor-side gear is started. As a result, the movement distance of the field of view from the origin can be controlled accurately.

In the microwave oven according to the present invention, the sensor-side gear preferably has a physically rotatable range in at least one of the rotation directions. The physically rotatable range is a physical rotation range of the sensor-side gear itself. Preferably, a rotation range defined by the respective rotation limits for moving the field of view in one and the other of the rotation directions is included in, and is smaller than, the physically rotatable range.

As a result, the sensor-side gear can move the field of view with a margin of the rotation range.

According to still another aspect of the present invention, a microwave oven is characterized in that it includes a heating chamber for accommodating an object, a heating portion for heating the object in the heating chamber, an infrared sensor having a field of view within the heating chamber, for detecting a temperature of the object in the heating chamber, a field-of-view moving portion for moving the field of view of the infrared sensor, and a demo executing portion for conducting a demonstration in which the field of view is moved and the infrared sensor is caused to conduct the temperature detection without operating the heating portion.

According to the present invention, the field of view of the infrared sensor can be moved in the microwave oven even in the case of the demonstration.

Accordingly, the ability of the infrared sensor to move the field of view thereof and to detect a food temperature regardless of the position of the food within the heating chamber can be more easily demonstrated.

Preferably, the microwave oven according to the present invention further includes a temperature display portion for displaying a temperature detected by the infrared sensor. Preferably, the temperature display portion does not display the detected temperature while the field-of-view moving portion is moving the field of view.

As a result, confusing temperature display can be avoided that results from continuous temperature display during movement of the field of view.

Preferably, the microwave oven according to the present invention further includes a presence determination portion for determining whether or not the object is present within the field of view of the infrared sensor, based on a detection result of the infrared sensor. Preferably, the field-of-view moving portion fixes a position of the field of view to a position of the object as determined by the presence determination portion, and the temperature display portion displays a temperature detected by the infrared sensor with the position of the field of view fixed by the field-of-view moving portion.

As a result, the temperature of the object is displayed in response to determination that the object is present within the heating chamber.

Accordingly, if the object is present within the heating chamber, the field of view of the infrared sensor is automatically moved to the position of the object, and the temperature of the object is displayed.

In the microwave oven according to the present invention, the presence determination portion preferably determines that the object is present at a certain position if a temperature detected by the infrared sensor with the field of view moved to the certain position is different at least by a predetermined value from a temperature detected by the infrared sensor with the field of view moved to a position adjacent to the certain position.

As a result, detection of the position of the object can be facilitated.

According to yet another aspect of the present invention, a microwave oven is characterized in that it includes a heating chamber for accommodating an object, a magnetron for supplying microwaves into the heating chamber, and a rotating antenna for rotating during oscillation of the microwaves by the magnetron in order to diffuse the microwaves oscillated by the magnetron, and in that a demonstration of the rotating antenna is conducted in which the rotating antenna is rotated without causing the magnetron to oscillate the microwaves.

According to the present invention, the rotating antenna that directly relates to a heating operation can be rotated without conducting the heating operation (microwave oscillation operation).

Accordingly, characteristics of the rotating antenna itself such as its rotating manner in the microwave oven can be more easily demonstrated.

Preferably, the microwave oven according to the present invention further includes a non-heating member for conducting an operation different from a heating operation in the microwave oven, and a normal demonstration is conducted in which the operation of the non-heating member is conducted without causing the magnetron to oscillate the microwaves. The demonstration of the rotating antenna and the normal demonstration are preferably conducted independently of each other.

As a result, capability of the rotating antenna that directly relates to the heating operation can be more easily demonstrated.

Preferably, the microwave oven according to the present invention further includes a door for opening and closing the heating chamber. Preferably, the rotating antenna is visually recognized more clearly when the door is opened, and the non-heating member includes a member that is visually recognized more clearly when the door is opened. The demonstration of the rotating antenna and the normal demonstration are preferably conducted with the door being opened.

As a result, the two demonstrations can be move effectively conducted.

Preferably, the microwave oven according to the present invention further includes a predetermined operation portion that is operated by a user. The demonstration of the rotating antenna and the normal demonstration are preferably conducted in response to operation of the predetermined operation portion.

As a result, a required number of operation portions in the microwave oven can be reduced.

In the microwave oven according to the present invention, an operation time of the predetermined operation portion that is required to conduct the demonstration of the rotating antenna is preferably longer than that required to conduct the normal demonstration.

As a result, an operator's interest in the demonstration of the rotating antenna that directly relates to the heating operation can be increased as compared to another demonstration.

In the microwave oven according to the present invention, a number of times to operate the predetermined operation portion that is required to conduct the demonstration of the rotating antenna is preferably larger than that required to conduct the normal demonstration.

As a result, an operator's interest in the demonstration of the rotating antenna that directly relates to the heating operation can be increased as compared to another demonstration.

Preferably, the microwave oven according to the present invention further includes a counting portion for counting a number of times the predetermined operation portion is operated. The counting portion preferably initializes its count value if a predetermined time has passed since the predetermined operation portion was operated first.

As a result, unwanted execution of the demonstration of the rotating antenna resulting from leaving the operated predetermined operation portion can be avoided.

According to one aspect of the invention, a method for controlling a microwave oven is characterized in that a field of view of an infrared sensor is moved in a central region of a heating chamber when the infrared sensor is caused to start temperature detection of an object within the heating chamber.

According to the present invention, a food can be more quickly included in the field of view of the infrared sensor when being placed in the central region of the heating chamber.

In the microwave oven, the food is often placed in the central region of the heating chamber. Therefore, in such a case, the food can be more quickly included in the field of view. In other words, heating of the food is less likely to be completed before the food is included in the field of view of the infrared sensor. As a result, convenience of the microwave oven can be improved.

According to another aspect of the invention, a method for controlling a microwave oven including an infrared sensor having a field of view within a heating chamber for detecting a temperature of an object in the field of view is characterized in that the method includes the step of detecting the temperature of the object by detecting an amount of infrared radiation within the field of view while moving the field of view, and in that the field of view is moved by rotation of a predetermined gear, and a movement origin of the field of view is defined as a position corresponding to a rotation limit of the predetermined gear.

According to the present invention, the distance between a tooth of a motor-side gear and a tooth of a sensor-side gear can be made constant. When the field of view of the infrared sensor is located at the origin, the sensor-side gear is biased in one of its rotation directions, and located at its rotation limit in one of the rotation directions.

In other words, the motor-side gear always rotates by a constant distance from the start of its rotation until the tooth thereof is brought into contact with the tooth of the sensor-side gear for power transmission thereto. Accordingly, the relation between the driving amount of the motor and the movement amount of the field of view of the infrared sensor is stabilized. As a result, the field of view of the infrared sensor can be moved more accurately.

According to still another aspect of the present invention, a method for controlling a microwave oven in which temperature detection by an infrared sensor is conducted with a field of view of the infrared sensor being moved within a heating chamber is characterized in that a demonstration of the infrared sensor is conducted by causing the infrared sensor to conduct the temperature detection without conducting a heating operation of a heating portion.

According to the present invention, the field of view of the infrared sensor can be moved in the microwave oven as a demonstration without conducting the heating operation of the heating portion.

Accordingly, the ability of the infrared sensor to move the field of view thereof and to detect a food temperature regardless of the position of the food within the heating chamber can be more easily demonstrated.

According to yet another aspect of the present invention, a method for controlling a microwave oven is characterized in that a demonstration of a rotating antenna provided in the microwave oven in order to diffuse microwaves emitted from a magnetron is conducted by rotating the rotating antenna without causing the magnetron to oscillate the microwaves.

According to the present invention, the rotating antenna that directly relates to a heating operation can be rotated without conducting the heating operation (microwave oscillation operation).

Accordingly, characteristics of the rotating antenna itself such as its rotating manner in the microwave oven can be more easily demonstrated.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 10 also includes auxiliary lines for illustrating the positions to which the field of view is moved.

DESCRIPTION OF THE PREFERRED EMBODIMENTS

Hereinafter, embodiments of the present invention will be described with reference to the accompanying drawings.

Figure 1:
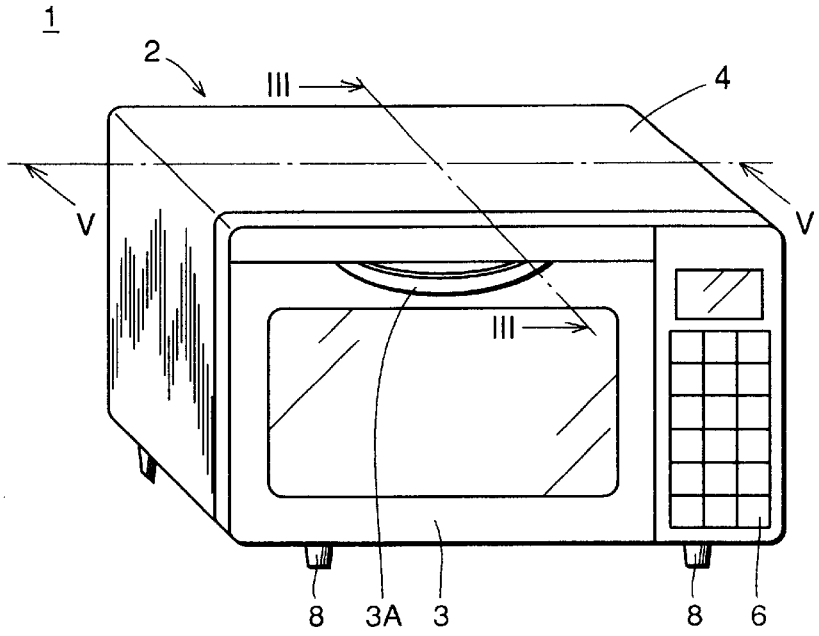
FIG. 1 is a perspective view of a microwave oven according to one embodiment of the present invention.

FIG. 1 is a perspective view of a microwave oven according to one embodiment of the present invention.

Referring to FIG. 1, the microwave oven 1 is mainly comprised of a main body 2 and a door 3. The main body 2 is enclosed by an outer sheath 4. An operation panel 6 for the user to input various kinds of information to the microwave oven 1 is provided on the front face of the main body 2. Note that the main body 2 is supported by a plurality of legs 8.

Figure 2:
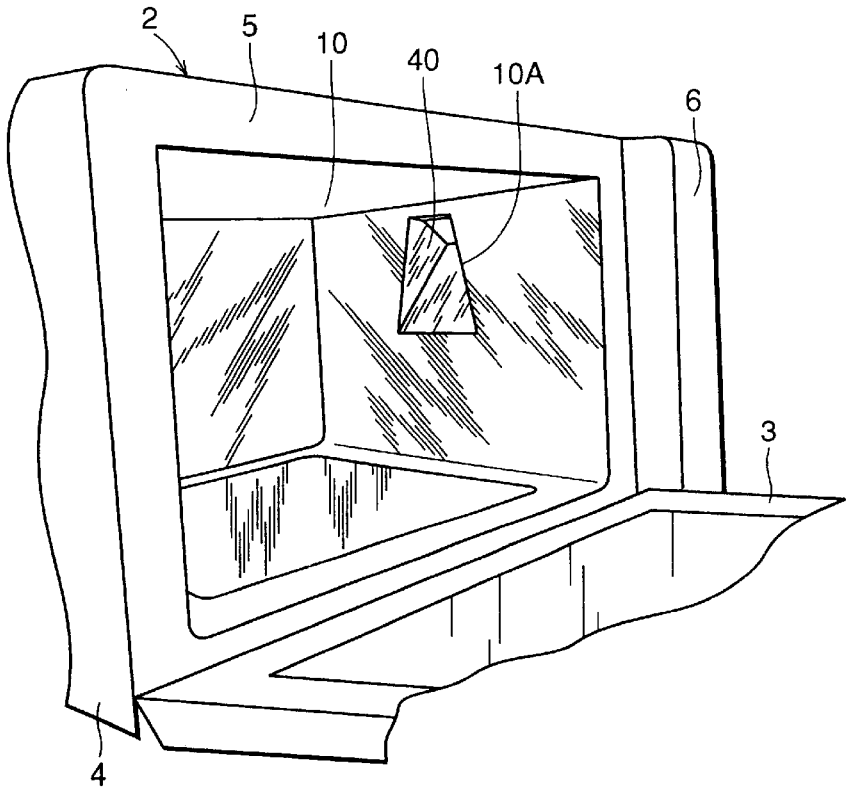
FIG. 2 is a perspective view of the microwave oven of FIG. 1 with its door being opened.

The door 3 is capable of being opened and closed about its lower end. The door 3 has a handle 3A at the top thereof. FIG. 2 is a partial perspective view of the microwave oven 1 with the door 3 opened, as viewed from the left front of the microwave oven 1.

A body frame 5 is provided inside the main body 2. The body frame 5 defines a heating chamber 10. The heating chamber 10 has a hole 10A in the upper portion of its right sidewall. A detection path member 40 is connected to the hole 10A from the outside of the heating chamber 10.

Figure 3:
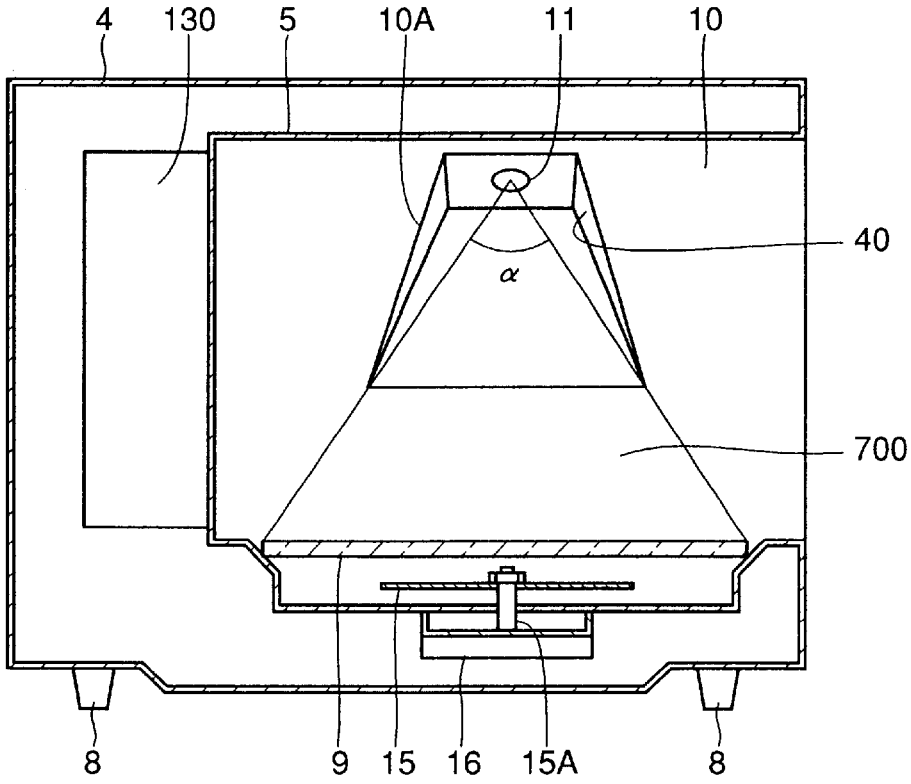
FIG. 3 is a cross sectional view taken along the line III—III of FIG. 1.
Figure 4:
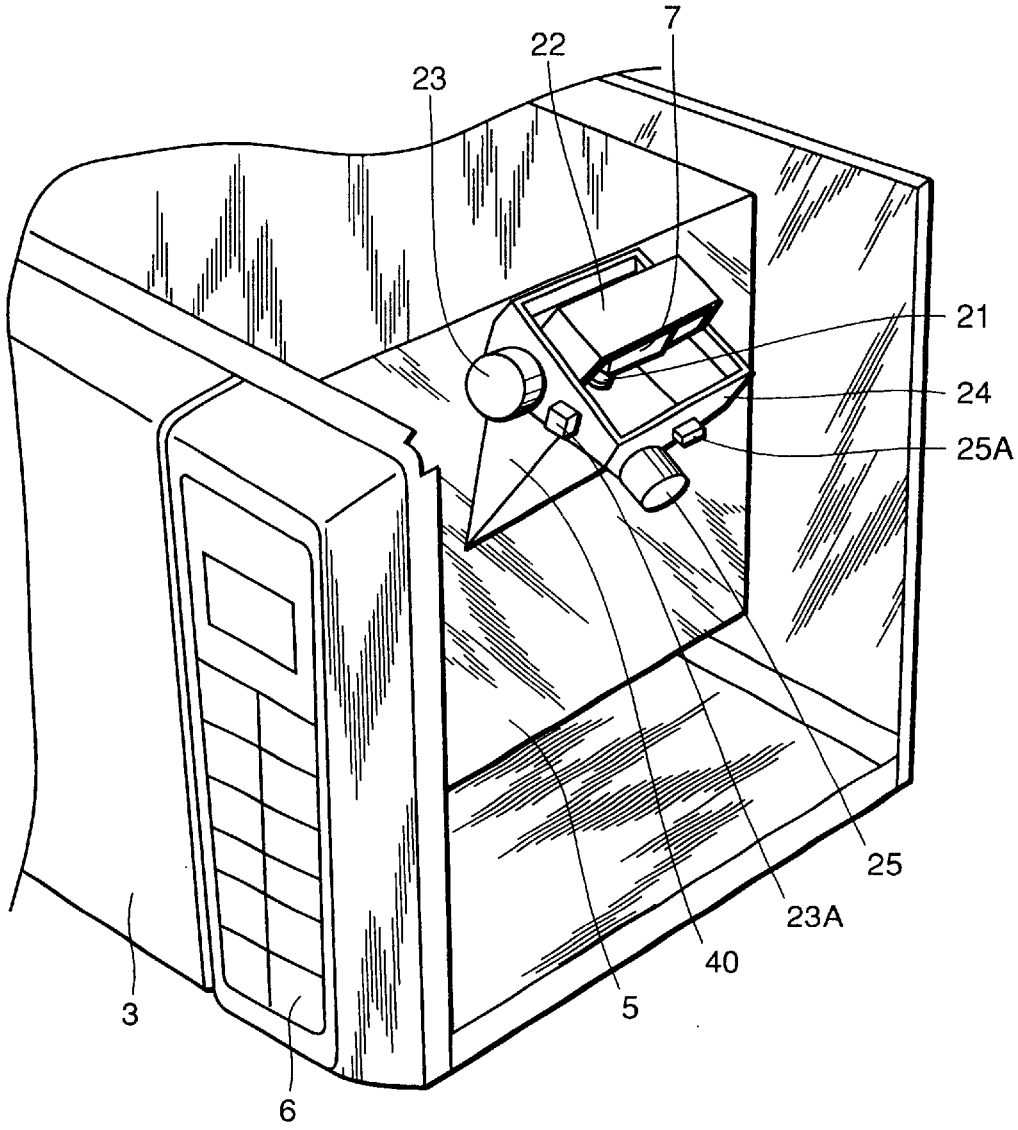
FIG. 4 is a perspective view of the microwave oven of FIG. 1 with its outer sheath being removed.
Figure 5:
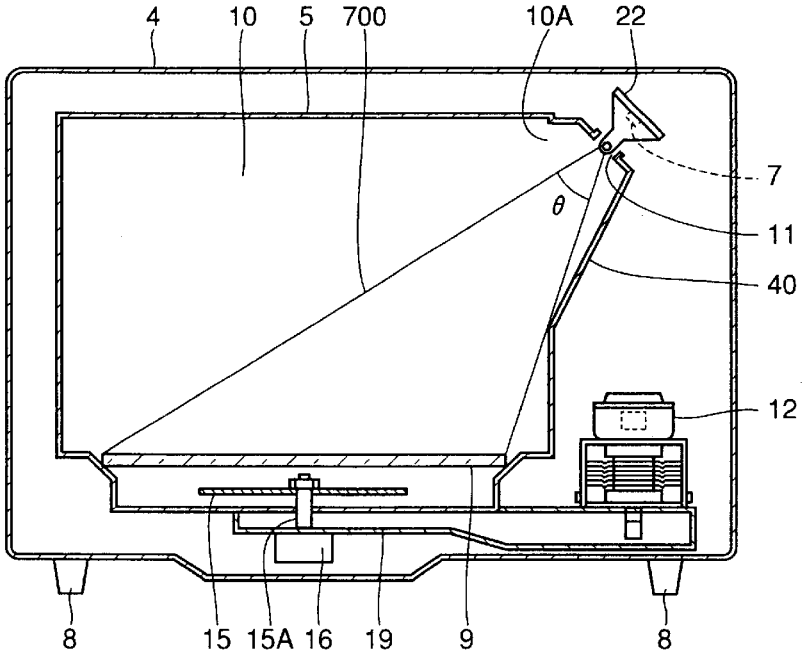
FIG. 5 is a cross sectional view taken along the line V—V of FIG. 1.

FIG. 3 is a cross sectional view taken along the line III—III of FIG. 1. FIG. 4 is a perspective view of the microwave oven 1 with the outer sheath 4 removed, as viewed from the upper right of the microwave oven 1. FIG. 5 is a cross sectional view taken along the line V—V of FIG. 1.

Referring to FIGS. 3 to 5, the detection path member 40 connected to the hole 10A has an opening, and has a box shape with the opening connected to the hole 10A. Note that the detection path member 40 has an infrared sensor 7 mounted to the bottom of the box. The infrared sensor 7 has a detection hole 21 for catching an infrared ray. A detection window 11 is formed in the bottom of the box-shaped detection path member 40 so as to face the detection hole 21 of the infrared sensor 7.

A magnetron 12 is provided within the outer sheath 4 so as to be adjacent to the lower right portion of the heating chamber 10. A wave guide 19 connecting the magnetron 12 to the lower portion of the heating chamber 10 is provided under the heating chamber 10. The magnetron 12 supplies microwaves into the heating chamber 10 through the wave guide 19.

The heating chamber 10 has a bottom plate 9 over its bottom. A rotating antenna 15 is provided between the bottom plate 9 and the bottom of the heating chamber 10. An antenna motor 16 is provided under the wave guide 19. The rotating antenna 15 and the antenna motor 16 are connected to each other by means of a shaft 15A. The rotating antenna 15 is driven to rotate by the antenna motor 16.

Within the heating chamber 10, a food is placed on the bottom plate 9. The microwaves emitted from the magnetron 12 are supplied through the wave guide 19 into the heating chamber 10 while being stirred by the rotating antenna 15. Thus, the food on the bottom plate 9 is heated.

A heater unit 130 is provided behind the heating chamber 10. The heater unit 130 accommodates a heater 13 which will be described later, and a fan for efficiently feeding the heat generated by the heater 13 into the heating chamber 10.

Figure 6:
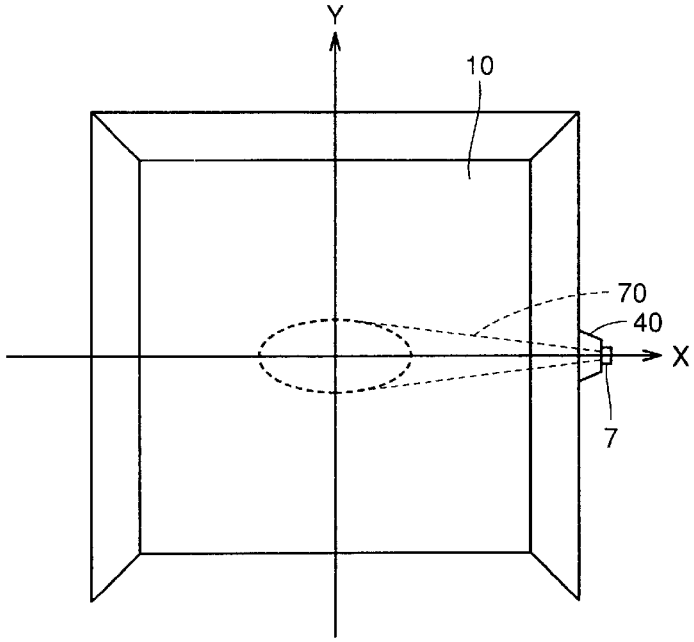
FIG. 6 is a diagram schematically showing X- and Y-axes defined on a heating chamber of the microwave oven of FIG. 1.

The infrared sensor 7 has a field of view. In the microwave oven 1, X- and Y-axes are defined on the bottom surface of the heating chamber 10. The field of view of the infrared sensor 7 can be moved in the X- and Y-axis directions. Hereinafter, the X- and Y-axes of the heating chamber 10 will be described. FIG. 6 schematically shows the X- and Y-axes defined on the heating chamber 10.

Referring to FIG. 6, in the heating chamber 10, the X-axis is defined in the width direction, and the Y-axis is defined in the depth direction. The infrared sensor 7 has a field of view 70, so that it can catch an emitted infrared ray within the field of view 70. The field of view 70 is projected as an ellipse onto the bottom surface of the heating chamber 10 (the surface including the bottom plate 9). Note that the ellipse in FIG. 6 is centered about the intersection of the X- and Y-axes (which is also the center of the bottom plate 9), and has a longer diameter in the X-axis direction, and a shorter diameter in the Y-axis direction. The position of the field of view 70 as shown in FIG. 6 is herein defined as a reference position thereof.

Referring also to FIG. 4, an X-direction pivot member 22 and a Y-direction pivot member 24 are mounted to the infrared sensor 7. An X-direction pivot motor 23 and a Y-direction pivot motor 25 are also mounted to the infrared sensor 7. The X-direction pivot member 22 is driven by the X-direction pivot motor 23 so as to move the field of view 70 of the infrared sensor 7 in the X direction. The Y-direction pivot member 24 is driven by the Y-direction pivot motor 25 so as to move the field of view 70 of the infrared sensor 7 in the Y direction.

Thus, the infrared sensor 7 can include a substantially entire region of the bottom surface of the heating chamber 7 in the field of view 70. In FIGS. 3 and 5, the maximum movement range of the field of view 70 within the heating chamber 10 is shown as the total field of view 700. In other words, referring particularly to FIG. 5, the field of view 70 moves in the X-axis direction so as to draw a triangle having an apex at the detection window 11, a bottom on the bottom plate 9, and an apex angle of $\theta$. Moreover, referring particularly to FIG. 3, the field of view 70 moves so as to draw a triangle having an apex at the detection window 11, a bottom on the bottom plate 9, and an apex angle of $\alpha$.

A motor drive detection switch 23A for detecting a driving manner of the X-direction pivot motor 23 is mounted to the X-direction pivot member 22 so as to be adjacent to the X-direction pivot motor 23. A motor drive detection switch 25A for detecting a driving manner of the Y-direction pivot motor 25 is mounted to the Y-direction pivot member 24 so as to be adjacent to the Y-direction pivot motor 25.

Figure 7:
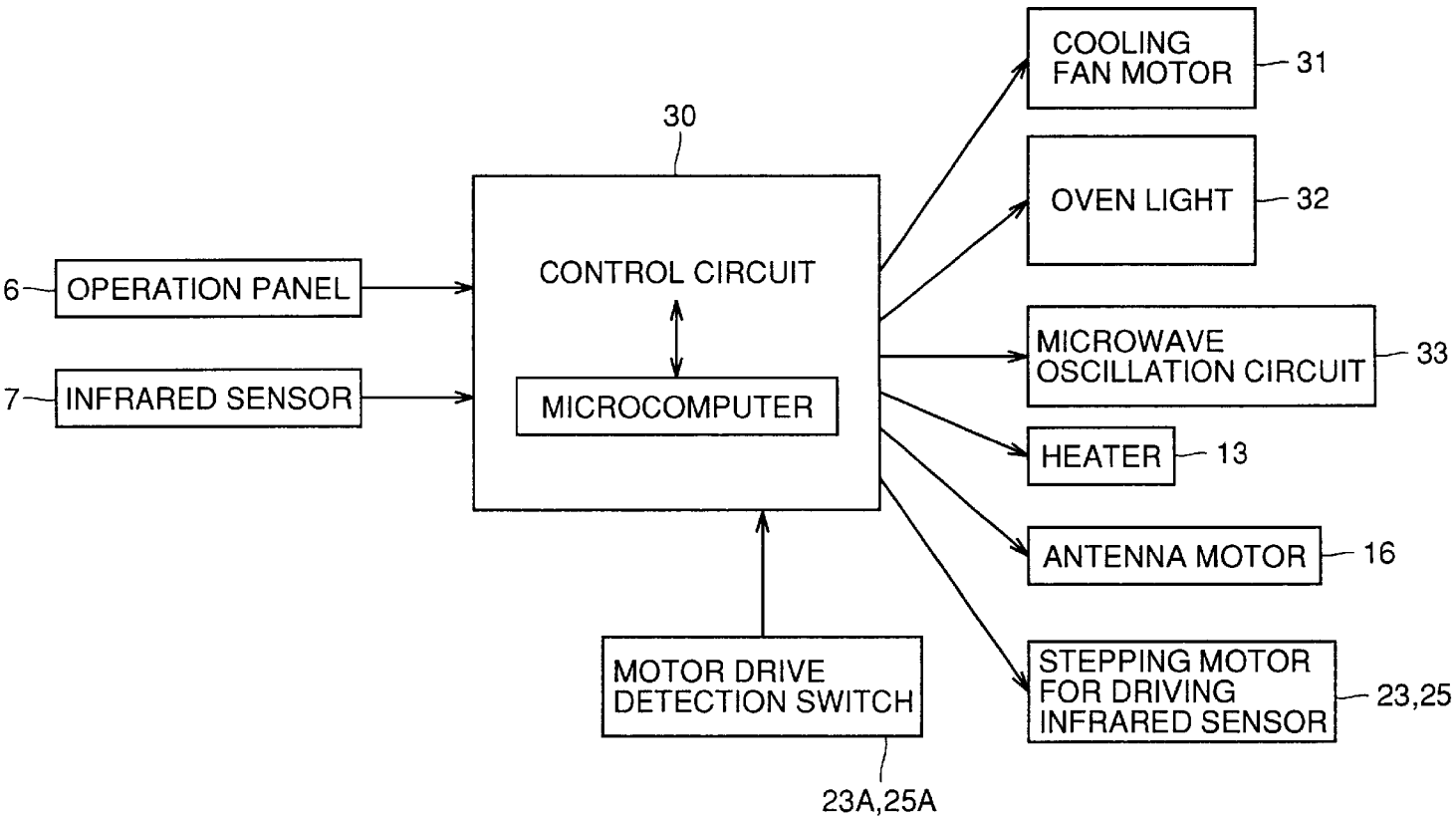
FIG. 7 is a control block diagram of the microwave oven of FIG. 1.

FIG. 7 is a control block diagram of the microwave oven 1. The microwave oven 1 includes a control circuit 30 for generally controlling the operation of the microwave oven 1. The control circuit 30 includes a microcomputer.

The control circuit 30 receives various kinds of information from the operation panel 6, infrared sensor 7, and motor drive detection switches 23A, 25A. Based on the received information and the like, the control circuit 30 controls the respective operation of a cooling fan motor 31, oven light 32, microwave oscillation circuit 33, heater 13, X-direction drive motor 23, and Y-direction drive motor 25. The cooling fan motor 31 is a motor for driving the fan for cooling the magnetron 12. The oven light 32 is an electric lamp for illuminating the inside of the heating chamber 10. The microwave oscillation circuit 33 is a circuit for causing the magnetron 12 to oscillate microwaves.

Figure 8:
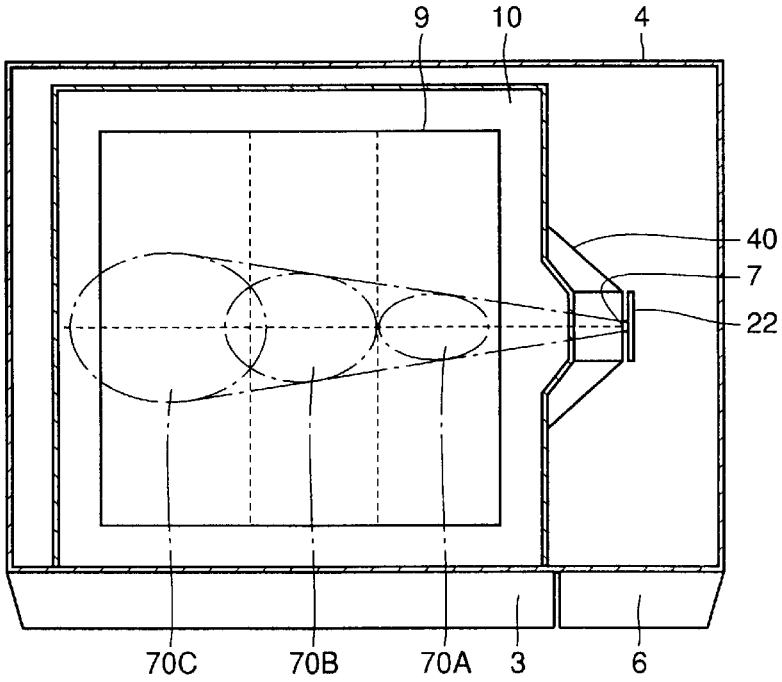
FIG. 8 is a diagram illustrating how a field of view of an infrared sensor of FIG. 6 changes in position as the field of view is moved in the X-axis direction of the heating chamber.

FIG. 8 is a diagram illustrating how the field of view 70 of the infrared sensor 7 changes in position as the X-direction pivot member 22 moves the field of view 70 of the infrared sensor 7 in the X-axis direction of the heating chamber 10 (see FIG. 6). Note that FIG. 8 and FIG. 9 that will be described later correspond to the diagrams of the microwave oven 1 with the outer sheath 4 removed, as viewed from the upper front of the microwave oven 1.

FIG. 8 shows three states of the field of view 70 within the heating chamber 10. These three states are sequentially denoted with 70A, 70B and 70C from right to left when viewed from above. Note that, in FIG. 8, the ellipse projected onto the bottom plate 9 is increased in size in the order of the field of views 70A, 70B and 70C, i.e., as the field of view 70 is moved to the left. This is because the distance between the projected position of the field of view 70 on the bottom plate 9 and the infrared sensor 7 is increased as the field of view 70 is moved to the left. Note that the position of the field of view 70B corresponds to the aforementioned reference position of the field of view 70.

Figure 9:
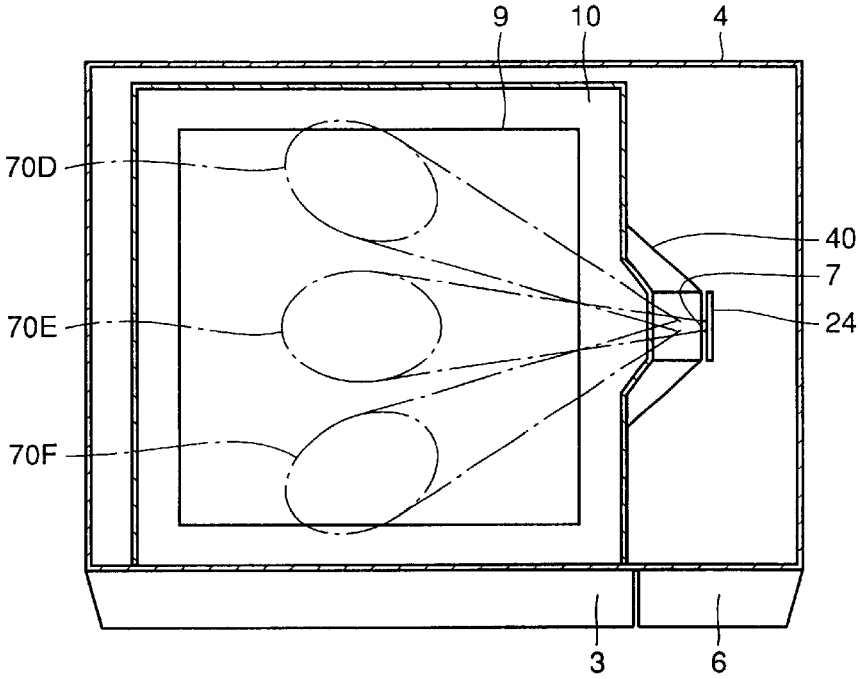
FIG. 9 is a diagram illustrating how the field of view of the infrared sensor of FIG. 6 changes in position as the field of view is moved in the Y-axis direction of the heating chamber.

FIG. 9 is a diagram illustrating how the field of view 70 of the infrared sensor 7 changes in position as the Y-direction pivot member 24 moves the field of view 70 in the Y-axis direction of the heating chamber 10 (see FIG. 6). FIG. 9 shows three states of the field of view 70 within the heating chamber 10. These three states are sequentially denoted with 70D, 70E and 70F from top to bottom when viewed from above. Note that, in FIG. 9, the shape of the ellipse projected onto the bottom plate 9 is different in each of the field of views 70D, 70E and 70F. This is because the distance and the positional relation between the projected position of the field of view 70 and the infrared sensor 7 are different.

Figure 10:
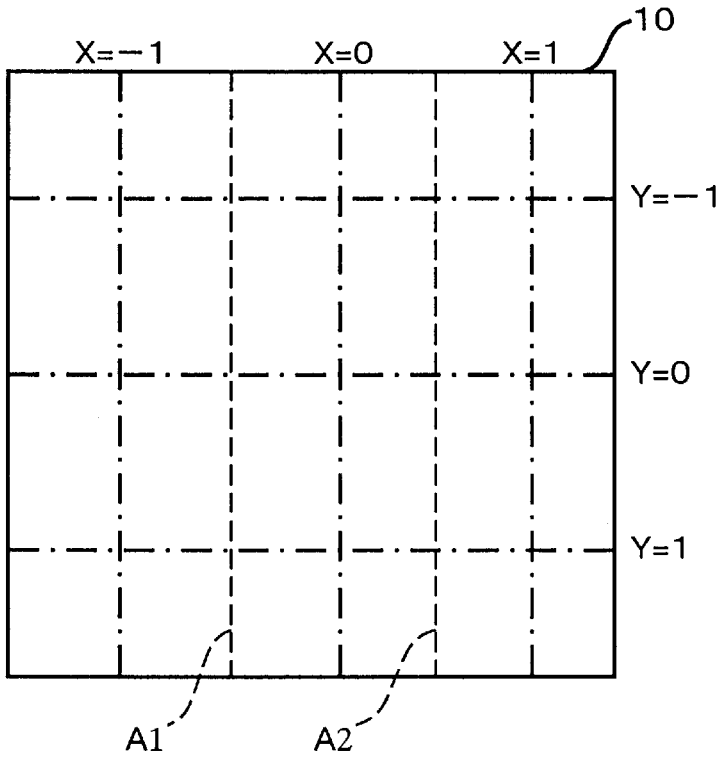
FIG. 10 is a diagram showing a place within the heating chamber of FIG. 1 on which a food can be placed.

Hereinafter, the positions to which the field of view 70 is moved during automatic cooking of the microwave oven 1 will be specifically described with reference to FIG. 10. FIG. 10 is a diagram schematically showing a surface (including the bottom plate 9) in the heating chamber 10 on which a food can be placed, as viewed from above. FIG. 10 also includes auxiliary lines for illustrating the positions to which the field of view 70 is moved.

In FIG. 10, three vertical single-dotted chain lines, two vertical dashed lines, and three horizontal single-dotted chain lines are shown in the heating chamber 10. The single-dotted chain lines in FIG. 10 are auxiliary lines based on the X- and Y-axes shown in FIG. 6. More specifically, the vertical single-dotted chain lines are straight lines of X=−1, 0, 1 from the left, and the horizontal single-dotted chain lines are straight lines of Y=−1, 0, 1 from the bottom. The vertical dashed lines (A1, A2) are drawn in order to divide the entire heating chamber 10 into three regions.

As described above, during automatic cooking of the microwave oven 1, the infrared sensor 7 detects the temperature of the food within the heating chamber 10. When it is determined that the temperature of the food has reached an appropriate temperature, heating is terminated. Note that the field of view 70 of the infrared sensor 70 cannot cover the entire region within the heating chamber 10 without being moved. By moving the field of view 70 (see FIGS. 3 and 5), the infrared sensor 7 can include the food in the field of view 70 regardless of the position of the food within the heating chamber 10.

Figure 11:
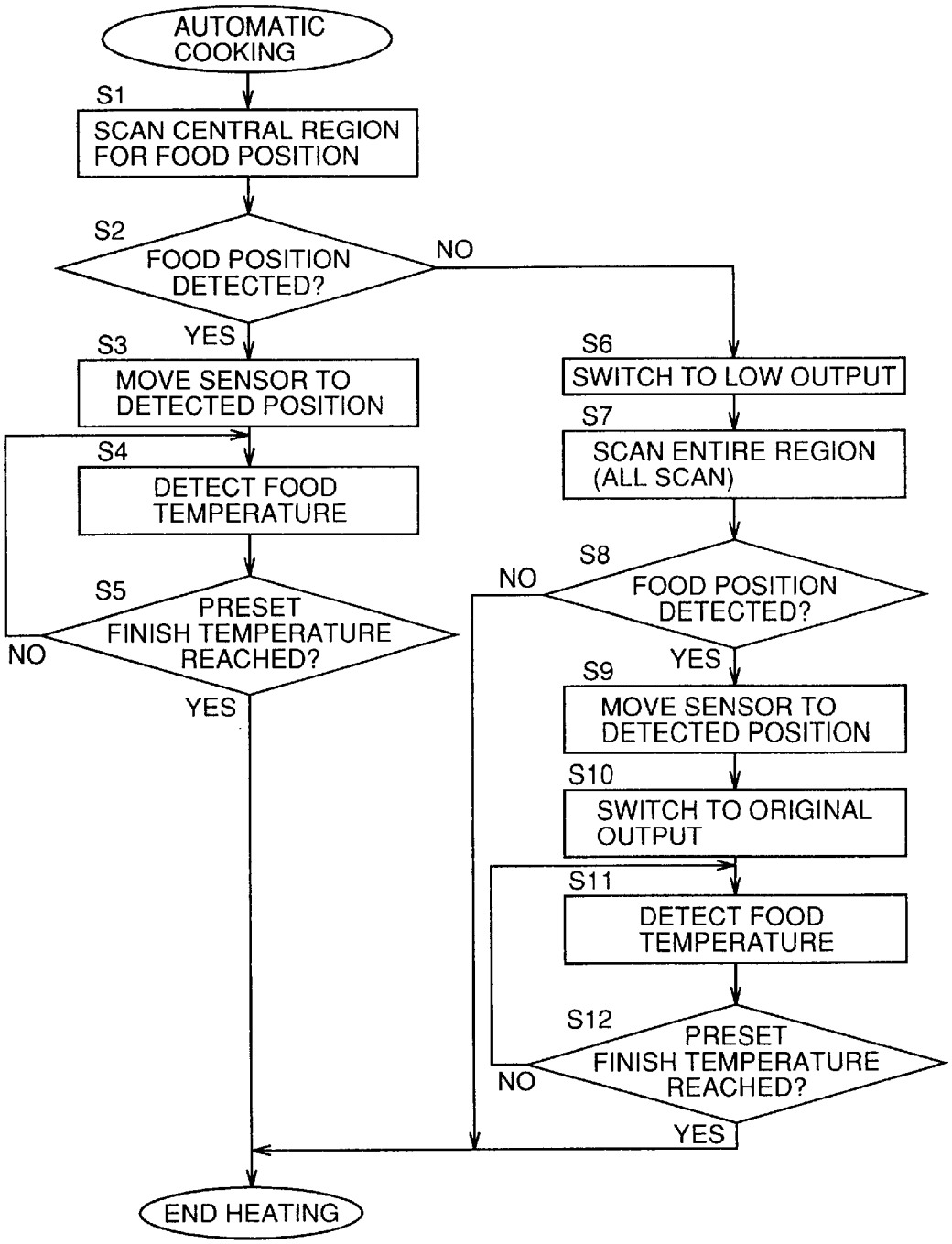
FIG. 11 is a flowchart illustrating an automatic cooking process conducted by a control circuit of FIG. 7.

Hereinafter, an automatic cooking process conducted by the control circuit 30 during such automatic cooking of the microwave oven 1 will be described. The automatic cooking process is a process in which the control circuit 30 moves the field of view 70 of the infrared sensor 7 so as to detect the temperature of an object within the field of view 70. In the automatic cooking process, the control circuit 30 determines the position of the food within the heating chamber 10 as well as determines whether or not the temperature of the food has reached the aforementioned appropriate temperature, based on the detection output of the infrared sensor 7. The control circuit 30 decides the termination timing of the heating operation based on the determination result. Hereinafter, the automatic cooking process will be described in detail. FIG. 11 is a flowchart illustrating a temperature detection process conducted by the control circuit 30.

After the heating operation by the magnetron 12 is started according to instruction to start the automatic cooking in the microwave oven 1, the control circuit 30 first causes the field of view of the infrared sensor 7 to scan the central region of the heating chamber 10 for temperature detection in Step S1 (hereinafter, the term "Step" will be omitted), and then advances control to S2. Note that "the central region of the heating chamber 10" as used herein corresponds to a region located at and around the point X=0, Y=0 in FIG. 10.

Then, in S2, the control circuit 30 determines whether or not the position of the food was able to be detected.

More specifically, in S2, the control circuit 30 determines whether or not there is a point where the temperature difference from the ambient temperature is a predetermined value or more, based on the scanning result in S1. If such a point is present, this means that the control circuit 30 was able to detect the position of the food. Therefore, the control circuit 30 determines that point as the position of the food.

If the position of the food was able to be detected in S2, the control circuit 30 advances control to S3. In S3, the control circuit 30 moves the field of view of the infrared sensor 7 to the detected position, and then advances control to S4.

In S4, the control circuit 30 detects the temperature of the food at the position of the field of view as moved in S3, and then advances control to S5.

In S5, the control circuit 30 determines whether or not the detected temperature of S4 has reached a temperature at which the heating is to be terminated (preset finish temperature). The steps S4 and S5 are repeated until the detected temperature of S4 reaches the preset finish temperature. If the detected temperature has reached the present finish temperature, the control circuit 30 terminates the automatic cooking process.

On the other hand, if the position of the food was not able to be detected in S2, the control circuit 30 advances control to S6. In S6, the control circuit 30 reduces the heating output (output of the magnetron 12), and then proceeds to S7. Note that, in the microwave oven 1, the normal heating output of the magnetron 12 may be, for example, 900 W, and the reduced heating output of S6 may be, for example, 500 W.

In S7, the control circuit 30 causes the infrared sensor 7 to scan the entire heating chamber 10 with the field of view while detecting a temperature (hereinafter, referred to as "all scan process"), and then advances control to S8. Note that the step S7 will be described later in detail.

In S8, the control circuit 30 determines whether or not the position of the food was able to be detected in the heating chamber 10, based on the scanning result of S7. Note that this determination is conducted in the same manner as that of S2. If the position of the food was able to be detected, the control circuit 30 moves the field of view of the infrared sensor 7 to the detected position in S9, and then advances control to S10. Note that, if the position of the food was not able to be detected in S8 based on the scanning result of S7, the heating is terminated, thereby terminating the automatic cooking process.

In S10, the control circuit 30 restores the reduced heating output of S6 to the original heating output at the start of the heating, and then advances control to S11.

In S11, the control circuit 30 detects the temperature of the food at the position of the field of view as moved in S9, and then advances control to S12.

In S12, the control circuit 30 determines whether or not the detected temperature of S11 has reached a temperature at which the heating is to be terminated (preset finish temperature). The steps S11 and S12 are repeated until the detected temperature of S11 reaches the preset finish temperature. If the detected temperature has reached the preset finish temperature, the control circuit 30 terminates the automatic cooking process.

In the above-described automatic cooking process, after the start of the heating, the central region of the heating chamber 10 is first scanned with the field of view of the infrared sensor 7 for temperature detection. This is because the food is often placed in the central region of the heating chamber 10 in the microwave oven 1. In many cases, the food in the heating chamber 10 can be quickly included in the field of view of the infrared sensor 7 by first scanning the central region with the field of view of the infrared sensor 7 like in the present embodiment.

As a result, even when cooking of the food in the heating chamber 10 is completed in a relatively short time, the detection result of the infrared sensor 7 can be utilized for the cooking. This is because of the ability to include the food within the heating chamber 10 in the field of view of the infrared sensor 7 and detect the temperature thereof before the cooking is completed.

Moreover, in the above-described automatic cooking process, if it is determined that the food is not placed in the central region of the heating chamber 10, the entire heating chamber 10 is scanned with the field of view of the infrared sensor 7. Therefore, the food can be included in the field of view of the infrared sensor 7 regardless of the position of the food in the heating chamber 10.

Moreover, in the automatic cooking process, if it is determined that the food is not placed in the central region of the heating chamber 10, the entire heating chamber 10 is scanned with the field of view of the infrared sensor 7 "after the heating output of the magnetron 12 is reduced". This is because the food is often placed in the central region of the heating chamber 10 in the microwave oven 1, as described above. In other words, if the food is not placed in the central region of the heating chamber 10, there is a possibility that the food is not placed in the heating chamber 12, and therefore the magnetron 12 is inhibited from conducting a wasteful heating operation as much as possible.

Moreover, in the automatic cooking process, the heating is discontinued if the position of the food cannot be detected as a result of the temperature detection conducted by moving the field of view of the infrared sensor 7 within the entire heating chamber 10. Thus, the microwave oven 1 can automatically discontinue the heating operation if the food is not placed in the heating chamber 10. Note that, in the case where it is determined that the food is not placed in the central region of the heating chamber 10, the heating may be immediately discontinued without conducting the scanning of the field of view any more. Even if the food is actually placed in the heating chamber 10, the microwave oven 1 may possibly discontinue the heating if the position of the food cannot be detected in S8 (or S2). In such a case, cooking can be manually conducted in the microwave oven 1.

In the present embodiment, the heating is immediately discontinued if the position of the food cannot be detected in S8. However, the heating may be discontinued after a predetermined time from completion of the step S8.

Figure 12:
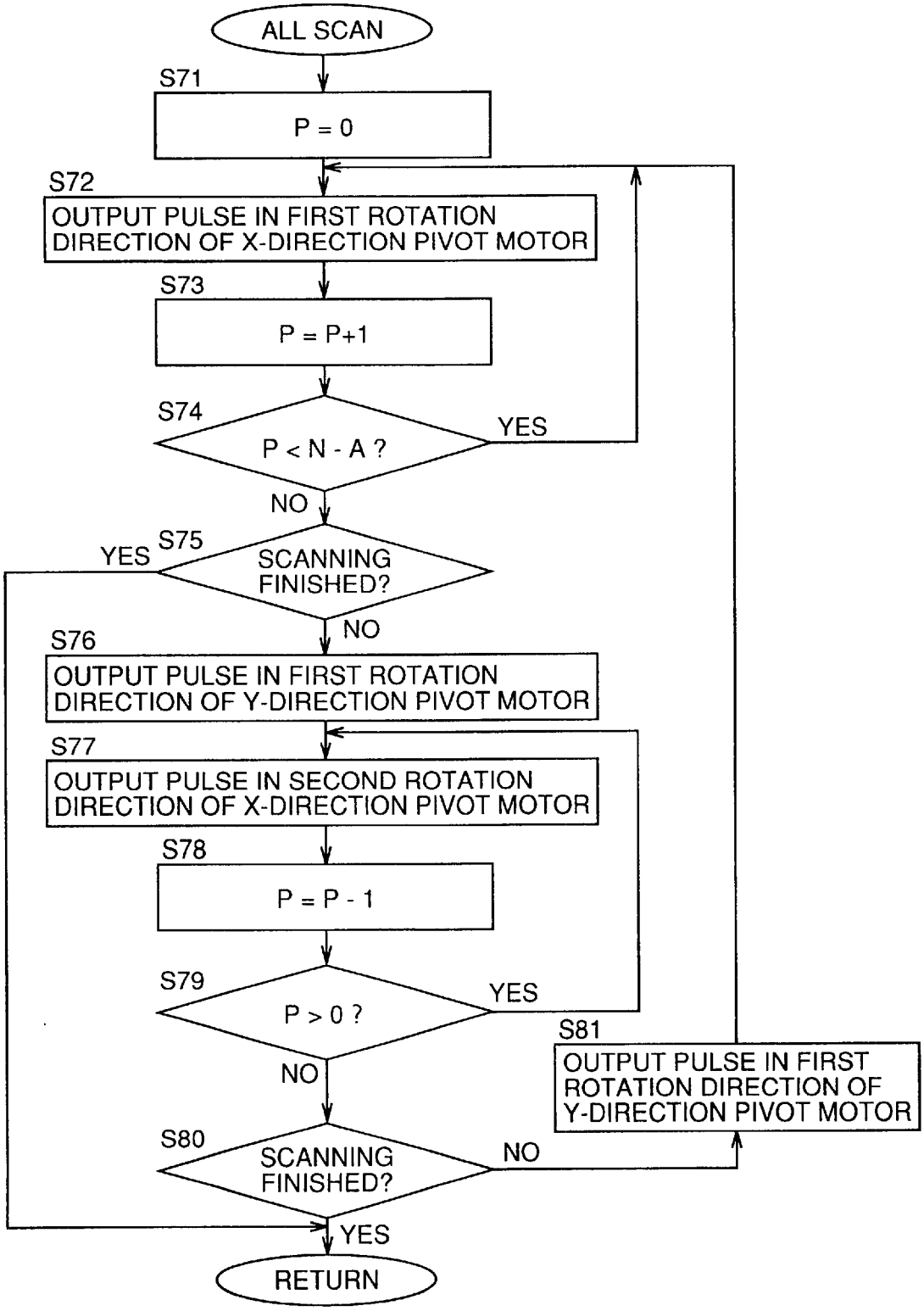
FIG. 12 is a flowchart illustrating a subroutine of an all scan process of FIG. 11.
Figure 13:
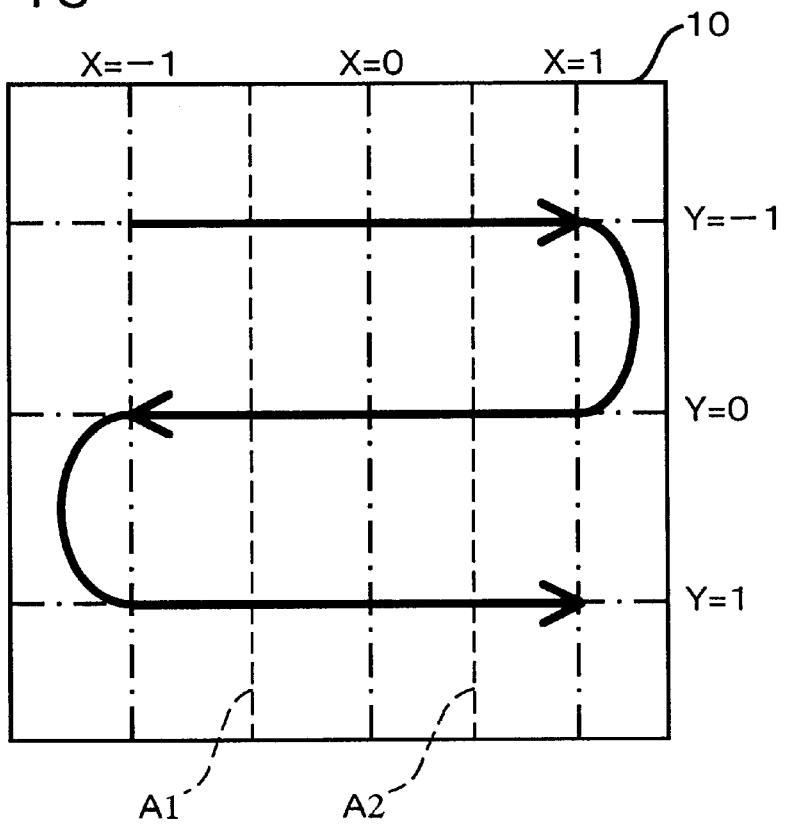
FIG. 13 is a diagram schematically showing a scan position of the field of view of the infrared sensor in the all scan process.
Figure 14:
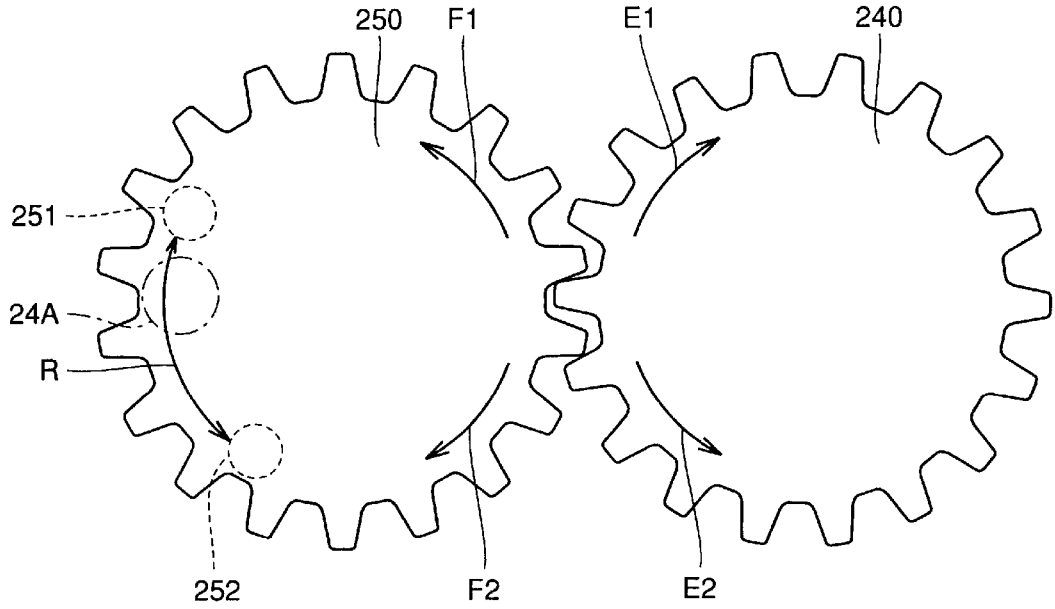
FIG. 14 is a diagram showing a gear mounted to a Y-direction pivot member and a gear mounted to a Y-direction pivot motor.

Hereinafter, the process of scanning the entire heating chamber 10 with the field of view of the infrared sensor 7 (all scan process) as conducted in S7 of FIG. 11 will be described with reference to FIGS. 12 to 14. FIG. 12 is a flowchart illustrating a subroutine of the all scan process. FIG. 13 is a diagram schematically showing the scan position of the field of view of the infrared sensor 7 in the all scan process. FIG. 14 is a diagram showing a gear mounted to the Y-direction pivot member 24 and a gear mounted to the Y-direction pivot motor 25.

In the all scan process shown in FIG. 12, the center of the field of view of the infrared sensor 7 is moved within the heating chamber 10 as shown by the thick arrow in FIG. 13. More specifically, the center of the field of view of the infrared sensor 7 is first moved to the position of X=−1, Y=−1, and then moved in the X-axis direction (horizontal direction) to the position of X=1, Y=−1. Subsequently, the center of the field of view is moved in the Y-axis direction (vertical direction) to the position of X=1, Y=0, and then moved in the X-axis direction to the position of X=−1, Y=0. Thereafter, the center of the field of view is moved in the Y-axis direction to the position of X=−1, Y=1, and then moved in the X-axis direction to the position of X=1, Y=1. Note that, as described above, the field of view of the infrared sensor 7 is projected onto the bottom surface of the heating chamber 10 as an ellipse having a certain area rather than as a point. Accordingly, the field of view of the infrared sensor 7 moved as shown in FIG. 13 covers a substantially entire region of the bottom surface of the heating chamber 10.

In the all scan process, the control circuit 30 first moves the position of the field of view of the infrared sensor 7 to the origin in S71, and then advances control to S72. The origin of the field of view as used herein does not refer to the aforementioned reference position, but refers to such a position that the center of the field of view is located at X=−1, Y=−1 shown in FIG. 10 or 13. Moreover, the letter "P" in FIG. 12 denotes a counter for the number of pulses transmitted to the X-direction pivot motor 23, and indicates the position of the field of view of the infrared sensor in the X direction. Note that "P=0" in S71 means that the center of the field of view of the infrared sensor 7 is located at X=−1.

In S72, the control circuit 30 outputs a pulse to the X-direction pivot motor 23 such that the X-direction pivot motor 23 rotates in a first rotation direction, and then advances control to S73. In S73, the control circuit 30 increments the counter P by one as a result of the pulse output in S72, and then advances control to S74. Note that the first rotation direction of the X-direction pivot motor 23 is a direction to move the field of view in the positive direction of the X-axis direction (i.e., to the right in FIG. 13). As a result of the pulse output in S72, the position of the field of view is moved in the positive direction of the X-axis direction by a predetermined distance. The X-direction pivot motor 23 is also rotatable in a second rotation direction. The second rotation direction is a direction opposite to the first rotation direction. More specifically, the second rotation direction is a direction to move the field of view in the negative direction of the X-axis direction (i.e., to the left in FIG. 13).

In S74, the control circuit 30 determines whether or not the count value of the counter P has reached "N−A", where N indicates a count value of the counter P that corresponds to the X-direction pivot motor 23 rotated to the maximum in the first rotation direction. "N−A" indicates a count value of the counter P that corresponds to the field of view moved to the limit position in the first rotation direction of the X-direction pivot motor 23.

In the present embodiment, the first and second rotation directions are defined also for the Y-direction pivot motor 25. The first rotation direction of the Y-direction pivot motor 25 is a direction to move the field of view in the positive direction of the Y-axis direction (i.e., the downward direction in FIG. 13). The second rotation direction of the Y-direction pivot motor 25 is a direction opposite to the first rotation direction. More specifically, the second rotation direction is a direction to move the field of view in the negative direction of the Y-axis direction (i.e., the upward direction in FIG. 13).

In the present embodiment, the X-direction pivot motor 23 and Y-direction pivot motor 25 can rotate in the first and second rotation directions in a broader range than the range to move the field of view to the limit. In other words, when the counter P has a count value N, the X-direction pivot motor 23 is at the rotation position corresponding to its physical rotation limit in a predetermined rotation direction. When the counter P has a count value N−A, the X-direction pivot motor 23 is at such a position that it can still rotate in a predetermined rotation direction, but can no longer move the field of view. This will be described with reference to FIG. 14.

FIG. 14 shows two gears (sensor-side gear 240, motor-side gear 250) in order to describe a mechanism for moving the field of view of the infrared sensor 7 by power transmission from the Y-direction pivot motor 25 to the Y-direction pivot member 24.

The sensor-side gear 240 is a gear fixed to the Y-direction pivot member 24, and rotates to move the field of view in the Y direction. The motor-side gear 250 rotates according to the power of the Y-direction pivot motor 25. The motor-side gear 250 is engaged with the sensor-side gear 240, so that the motor-side gear 250 can transmit the power of the Y-direction pivot motor 25 to the sensor-side gear 240. More specifically, when the motor-side gear 250 is driven by the Y-direction pivot motor 25 to rotate in the direction F1, the sensor-side gear 240 rotates in the direction E1 accordingly. Moreover, when the motor-side gear 250 is driven by the Y-direction pivot motor 25 to rotate in the direction F2, the sensor-side gear 240 rotates in the direction E2 accordingly. Note that the direction F1 of the motor-side gear 250 corresponds to the first rotation direction of the Y-direction pivot motor 25, and the direction F2 of the motor-side gear 250 corresponds to the second rotation direction of the Y-direction pivot motor 25.

The motor-side gear 250 has projections 250, 252 thereon. The Y-direction pivot member 24 has a projection 24A on its surface facing the projections 251, 252. When the projection 251 abuts on the projection 24A, the motor-side gear 250 cannot rotate any more in the direction F1. Accordingly, when the projection 251 abuts on the projection 24A, the motor-side gear 250 is at the rotation limit of the first rotation direction. Similarly, when the projection 252 abuts on the projection 24A, the motor-side gear 250 is at the rotation limit of the second rotation direction.

Therefore, the rotatable range of the Y-direction pivot motor 25 extends from the position where the projection 24A abuts on the projection 251 of the motor-side gear 250 to the position where the projection 24A abuts on the projection 252. In other words, the rotatable range of the Y-direction pivot motor 25 is such a range that the projection 24A is located between the projections 251, 252 as shown by the arrow R. The rotation range of the Y-direction pivot motor 25 for moving the field of view is smaller than the rotatable range of the Y-direction pivot motor 25. In other words, even if the field of view is moved to the maximum, the projection 24A moves only in a range smaller than that shown by the arrow R. Similarly, the rotation range of the X-direction pivot motor 23 for moving the field of view is smaller than the rotatable range of the X-direction pivot motor 23.

Such a structure enables the X-direction pivot motor 23 and Y-direction pivot motor 25 to move the field of view with a margin. As a result, the field of view can be moved more accurately.

In other words, in the present embodiment, the physically rotatable range is defined by the rotatable range of the motor-side gear 250 (the range shown by the arrow R). Moreover, a rotation limit for moving the field of view is defined by a limit position of the rotation range in which the motor-side gear 250 can rotate in order to move the field of view.

Note that, as described above, the sensor-side gear 240 can be rotated by rotation of the motor-side gear 250. Moreover, the field of view is moved according to the rotation distance of the sensor-side gear 240. In other words, the field of view can be moved by rotation of the motor-side gear 250. The aforementioned rotation limit for moving the field of view refers to a limit position to which the motor-side gear 250 can rotate in order to move the field of view. The rotation limit for moving the field of view is located inside the range shown by the arrow R in FIG. 14.

Note that the sensor-side gear 240 is biased in the direction E1. Thus, the respective teeth of the sensor-side gear 240 and the motor-side gear 250 are always engaged with each other in the same state. Thus, the relation between the driving force of the Y-direction pivot motor 25 and the rotation distance of the sensor-side gear 240 is stabilized. Therefore, by controlling the number of pulses transmitted to the Y-direction pivot motor 25, the movement distance of the field of view in the Y-axis direction can be accurately controlled.

The X-direction pivot motor 23 also moves the field of view in the X direction by moving the X-direction pivot member 22 with the same gear-based mechanism as that shown in FIG. 14. Note that the sensor-side gear in this system rotates on the vertical plane, and therefore is biased by the self-weight in one of its rotation directions. Thus, in this system as well, the relation between the driving force of the X-direction pivot motor 23 and the rotation distance of the sensor-side gear is stabilized. Therefore, by controlling the number of pulses transmitted to the X-direction pivot motor 23, the movement distance of the field of view in the X-axis direction can be accurately controlled.

Moreover, in the present embodiment, the origin of the field of view is located at the movement limit of the field of view in the positive direction of the X direction (X=1) and in the negative direction of the Y direction (Y=−1). Note that the movement limit in the Y direction refers to the movement limit in the direction in which the sensor-side gear 240 is biased (negative direction, direction E1).

Thus, when the field of view is located at the origin, a tooth of the sensor-side gear 240 is engaged with a tooth of the motor-side gear 250 such that the side surface of the tooth of the sensor-side gear 240 that is located in the biasing direction is in contact with the tooth of the motor-side gear 250. In FIG. 14, this corresponds to the fact that the upper end of the tooth of the sensor side gear 240 is in contact with the tooth of the motor side gear 250 in the engaged portion of both gears.

The respective teeth of the motors are engaged by contacting each other in such a manner as described above. Thus, in the case where the field of view is moved from the origin to the positive direction of the Y-axis direction (direction E2), the rotation force of the motor-side gear 250 is transmitted to the sensor-side gear 240 as soon as the motor side gear 250 starts rotating.

Referring back to FIG. 12, if it is determined in S74 that P has not reach N−A, the control circuit 30 returns control to S72. On the other hand, if it is determined in S74 that P has reached N−A, the control circuit 30 advances control to S75. Note that the determination whether P has reached N−A or not corresponds to determination whether or not the field of view has reached the movement limit in the first rotation direction of the X direction at the current position in the Y direction (e.g., Y=−1), i.e., whether or not the field of view has scanned the whole movable range in the X direction.

In S75, the control circuit 30 determines whether or not the field of view has scanned the whole range of the heating chamber 10. If it is determined that the field of view has scanned the whole range, the process is terminated and returned. On the other hand, if it is determined that the field of view has not scanned the whole range, the control circuit 30 advances control to S76.

In S76, the control circuit 30 outputs a pulse in the first rotation direction of the Y-direction pivot motor 25, and then advances control to S77. Note that, in response to the pulse output in the first rotation direction of the Y-direction pivot motor 25 in S76, the field of view of the infrared sensor is moved by a predetermined distance in the positive direction of the Y direction (downward direction in FIG. 13).

In S77, the control circuit 30 outputs a pulse in the second rotation direction of the X-direction pivot motor 23, and then advances control to S78. Note that, in response to the pulse output in the second rotation direction of the X-direction pivot motor 23 in S77, the field of view of the infrared sensor is moved by a predetermined distance in the negative direction of the X direction (to the left in FIG. 13).

In S78, the control circuit 30 decrements the count value of the counter P by one, and then advances control to S79.

In S79, the control circuit 30 determines whether or not P has reduced to zero. If P has reduced to zero, the control circuit 30 advances control to S80. On the other hand, if P has not reduced to zero, the control circuit 30 returns control to S77. Note that the determination whether or not P has reduced to zero corresponds to determination whether or not the field of view has reached the movement limit in the second rotation direction of the X direction, i.e., whether or not the field of view has returned to the origin of the X direction.

In S80, the control circuit 30 determines whether or not the field of view has scanned the entire heating chamber 10. If it is determined that the field of view has scanned the entire heating chamber 10, the process is terminated and returned. On the other hand, if it is determined that the field of view has not yet scanned the entire heating chamber 10, the control circuit 30 outputs a pulse in the first rotation direction of the Y-direction pivot motor 25 in S81, and then returns control to S72.

According to the all scan process as described above, the field of view of the infrared sensor 7 moves from a corner of the heating chamber 10 (the position of X=−1, Y=−1, the origin of the field of view) rightward, forward (downward in FIG. 13), leftward, forward, and then rightward, as shown in FIG. 13.

Note that, in the microwave oven 1, the control circuit 30 conducts a motor operation detection process in parallel with the automatic cooking process. The motor operation detection process is a process for determining whether the X-direction pivot motor 23 and Y-direction pivot motor 25 are operating accurately or not, based on the detection output of the motor drive detection switches 23A, 25A. Hereinafter, the motor operation detection process will be described.

Figure 15:
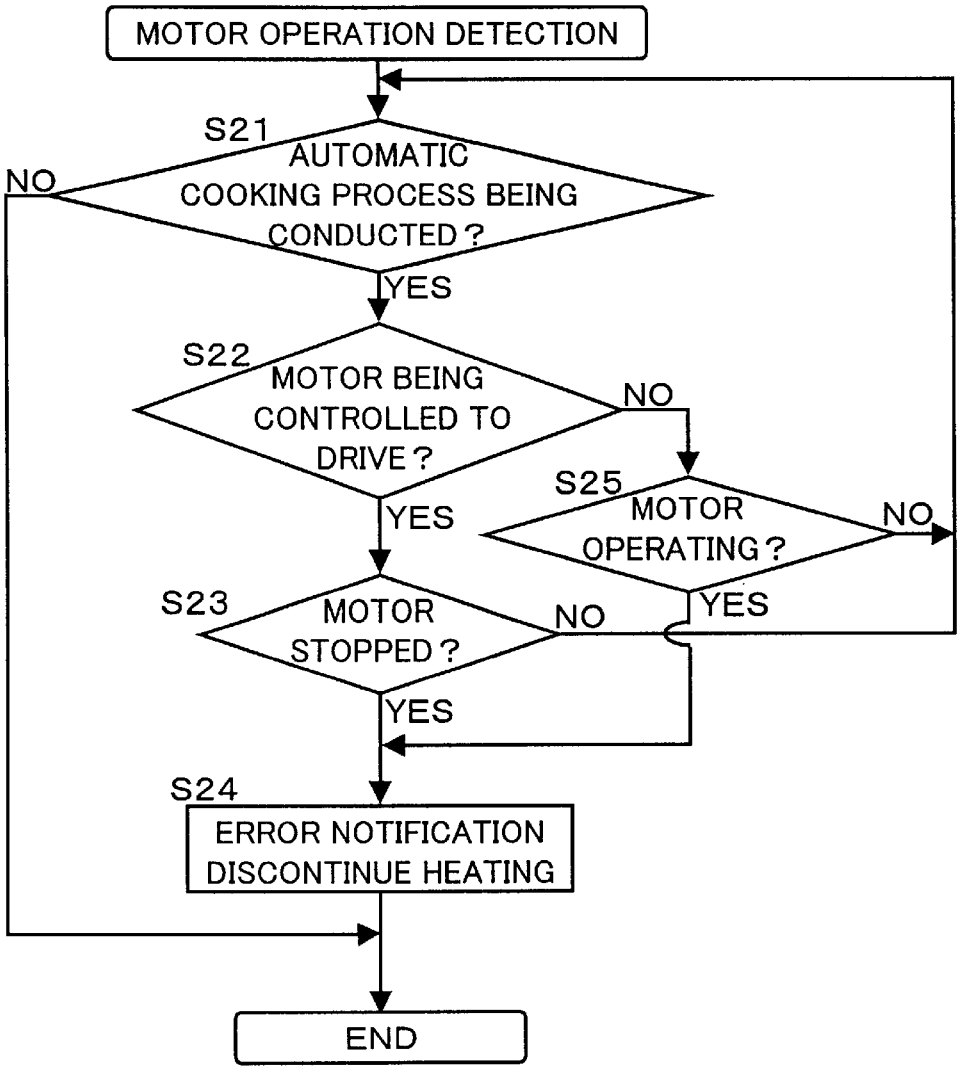
FIG. 15 is a flowchart illustrating a motor operation detection process conducted by the control circuit of FIG. 7.

FIG. 15 is a flowchart illustrating the motor operation detection process. Referring to FIG. 15, the control circuit 30 first determines in S21 whether the automatic cooking process is being conducted or not. If the automatic cooking process is not being conducted, the motor operation detection process is terminated. On the other hand, if the automatic cooking process is being conducted, the control circuit 30 advances control to S22.

In S22, the control circuit 30 determines whether or not it is controlling one of the above-mentioned two motors so that it operates to drive. If the control circuit 30 is controlling one of the motors so that it operates to drive, it advances control to S23. On the other hand, if the control circuit 30 is not controlling any one of the motors so that it operates to drive, it advances control to S25.

In S23, the control circuit 30 determines whether or not the motor has stopped, based on the detection output of the motor drive detection switch 23A, 25A. If the motor is driving, the control circuit 30 determines that the motor is being controlled normally, thereby returning control to S21. On the other hand, if the motor has stopped, the control circuit 30 advances control to S24. In S24, the control circuit 30 notifies that the motor is not driving as controlled and discontinues the heating by the magnetron 12, thereby terminating the process. Note that, in the microwave oven 1, various notifications may be conducted, for example, on a display panel provided in the operation panel 6.

In S25, the control circuit 30 determines whether or not the motors are driving, based on the respective detection outputs of the motor drive detection switches 23A, 25A. If the motors have stopped, the control circuit 30 determines that the motors are being controlled normally, thereby returning control to S21. If the motor(s) is still driving contrary to the control, the control circuit 30 advances to S24. In S24, the control circuit 30 notifies that the motor(s) has not stopped as controlled and discontinues the heating by the magnetron 12, thereby terminating the process.

According to the motor operation detection process as described above, the error notification is conducted as well as the heating is discontinued if the X-direction pivot motor 23 and/or the Y-direction pivot motor 25 are not operating or have not stopped when they should.

The microwave oven 1 is capable of conducting a demonstration. In the demonstration, only non-heating members that conduct an operation different from the heating operation (such as infrared sensor 7 and operation panel 6) are operated without conducting the heating operation. Such a demonstration is mainly conducted at the stores in order to show the capabilities of the non-heating members in the microwave oven 1. Note that the microwave oven 1 is also capable of operating only the rotating antenna 15 without operating the magnetron 12. In other words, the microwave oven 1 is capable of conducting a demonstration of the rotating antenna 15 that directly relates to the heating operation by the magnetron 12.

Figure 16:
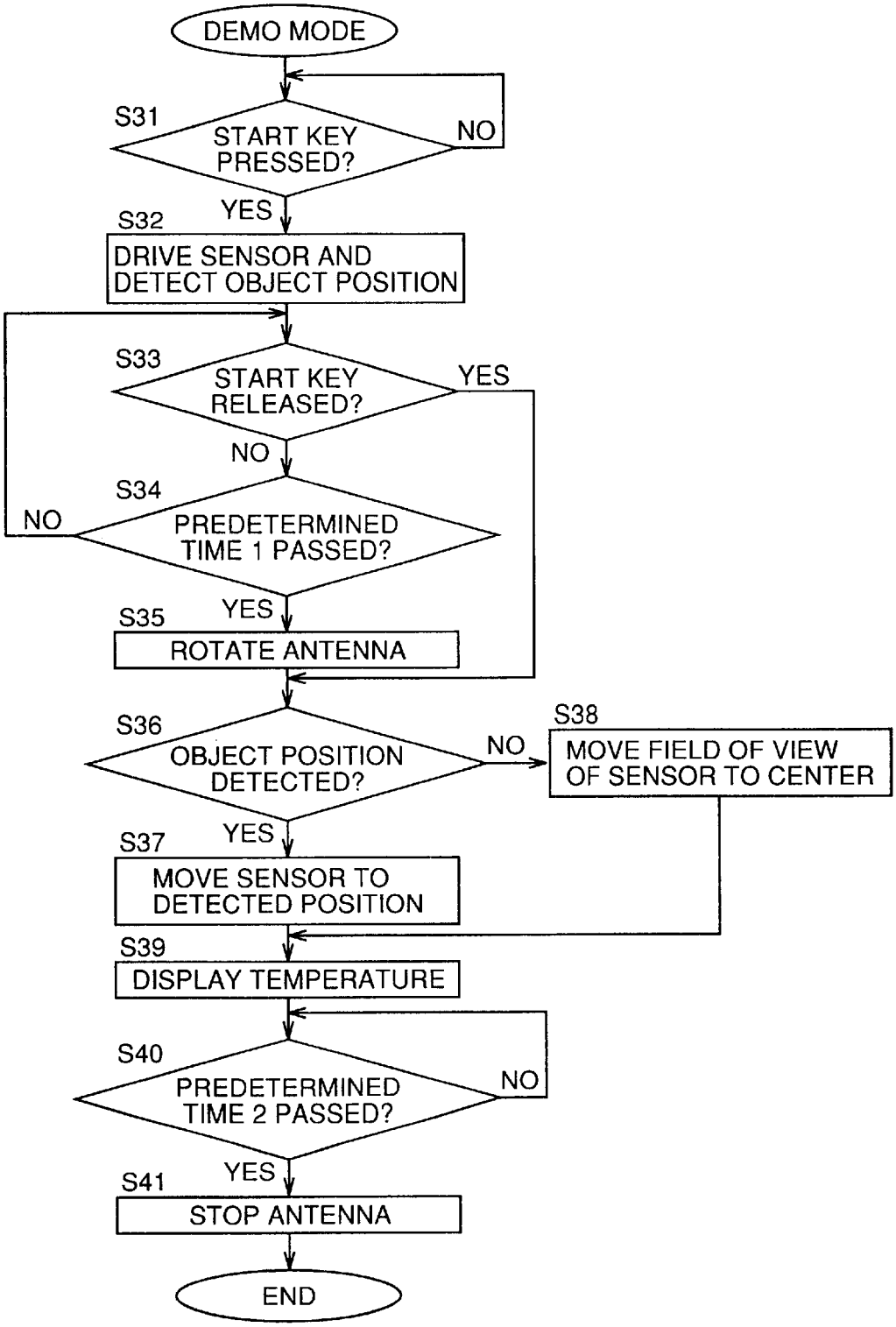
FIG. 16 is a flowchart illustrating a demo-mode process conducted by the control circuit of FIG. 7.

Hereinafter, a demo-mode process conducted by the control circuit 30 for the demonstration of the microwave oven 1 will be described. FIG. 16 is a flowchart illustrating the demo-mode process.

Referring to FIG. 16, the control circuit 30 determines in S31 whether a key for stating the demo-mode (hereinafter, simply referred to as "start key") has been pressed or not. If it is determined that the start key has been pressed, the control circuit 30 advances control to S32.

In S32, the control circuit 30 causes the field of view of the infrared sensor 7 to scan the entire heating chamber 10 in order to detect the position of an object within the heating chamber 10, and then advances control to S33. The term "object" as used herein refers to a measurement object for the purpose of showing the temperature-measurement capability of the infrared sensor 7, and therefore is not necessarily a food.

In S33, the control circuit determines whether the pressed start key has been released or not. If it is determined that the start key has been released, the control circuit 30 advances control to S36. If it is determined that the start key has not been released, i.e., that the start key has still been pressed, the control circuit 30 advances control to S34.

In S34, the control circuit 30 determines whether or not a "predetermined time 1" has passed since pressing of the start key was started, i.e., whether or not the start key has been pressed for the "predetermined time 1". The "predetermined time 1" as used herein refers to a predetermined, specific time period. Similarly, a "predetermined time 2", "predetermined time 3", and "predetermined time 4" as described later each refers to a predetermined, specific time period. Note that these time periods are determined independently of each other. If it is determined in S34 that the "predetermined time 1" has passed, the control circuit 30 advances control to S35. If it is determined that the "predetermined time 1" has not been passed, the control circuit 30 returns control to S33.

In S35, the control circuit 30 rotates the rotating antenna 15, and then advances control to S36.

In S36, the control circuit 30 determines whether or not the object was able to be detected at any position within the heating chamber 10 as a result of the scanning in S32. This determination is conducted by determining whether or not the temperature difference of a predetermined value or more from an adjacent position was able to be detected at any position within the heating chamber 10. Herein, it is assumed that the object has a temperature difference of the predetermined value or more from the bottom of the heating chamber 10. Note that the object having the temperature difference of the predetermined value or more not only means that the temperature of the object is higher than that of the bottom of the heating chamber 10, but also means that the temperature of the object is lower than that of the bottom of the heating chamber 10.

If the object was able to be detected in S36, the control circuit 30 then advances control to S37. If the object was not able to be detected, the control circuit 30 advances control to S38.

In S37, the control circuit 30 moves the field of view of the infrared sensor 7 to the detected position of the object of S36, and then advances control to S39.

In S38, the control circuit 30 moves the field of view of the infrared sensor 7 to the center of the heating chamber 10 (the aforementioned reference position), and then advances control to S39.

In S39, the control circuit 30 displays the temperature detected by the infrared sensor 7 on the display panel provided in the operation panel 6, and then advances control to S40. Note that the displayed temperature herein refers to the temperature of the object if the object was able to be detected in S36, and refers to the temperature of the center of the bottom of the heating chamber 10 if not.

In S40, the control circuit 30 determines whether or not the "predetermined time 2" has passed since the start key was pressed in S31, i.e., since the step S32 of the demo-mode process was started. If it is determined that the "predetermined time 2" has passed, the control circuit 30 discontinues rotation of the rotating antenna 15 in S41, thereby terminating the process.

In the demo-mode process described above, the demonstration of the infrared sensor 7 is conducted in response to pressing of the start key. Note that, if the start key has been pressed for the "predetermined time 1" or more, the demonstration of the rotating antenna 15 is also conducted together with the demonstration of the infrared sensor 7.

In other words, the respective demonstrations of the infrared sensor 7 and the rotating antenna 15 are conducted by operating the same key. Note that, in order to conduct the demonstration of the rotating antenna 15, the start key must be pressed for a time period longer than that required for conducting only the demonstration of the infrared sensor 7.

Moreover, the aforementioned demonstrations are conducted regardless of whether the door 3 is closed or not, i.e., even if the door 3 is opened.

If the start key is pressed, the demonstration of the infrared sensor 7 is conducted regardless of whether the demonstration of the rotation antenna 15 is to be conducted or not.

Note that an operation key for demonstrating the rotating antenna 15 may be provided in the operation panel 6 so that the demonstration of the rotating antenna 15 can be conducted regardless of whether the demonstration of the infrared sensor 7 is to be conducted or not.

Moreover, in the demonstration of the infrared sensor 7, the field of view of the infrared sensor 7 is moved. If the object was detected, the field of view is moved to the detected position of the object, and the temperature at that position is displayed. Note that it is preferable that the temperature detected by the infrared sensor 7 is displayed for the first time in S39 and is not displayed during detection of the position of the object.

Figure 17:
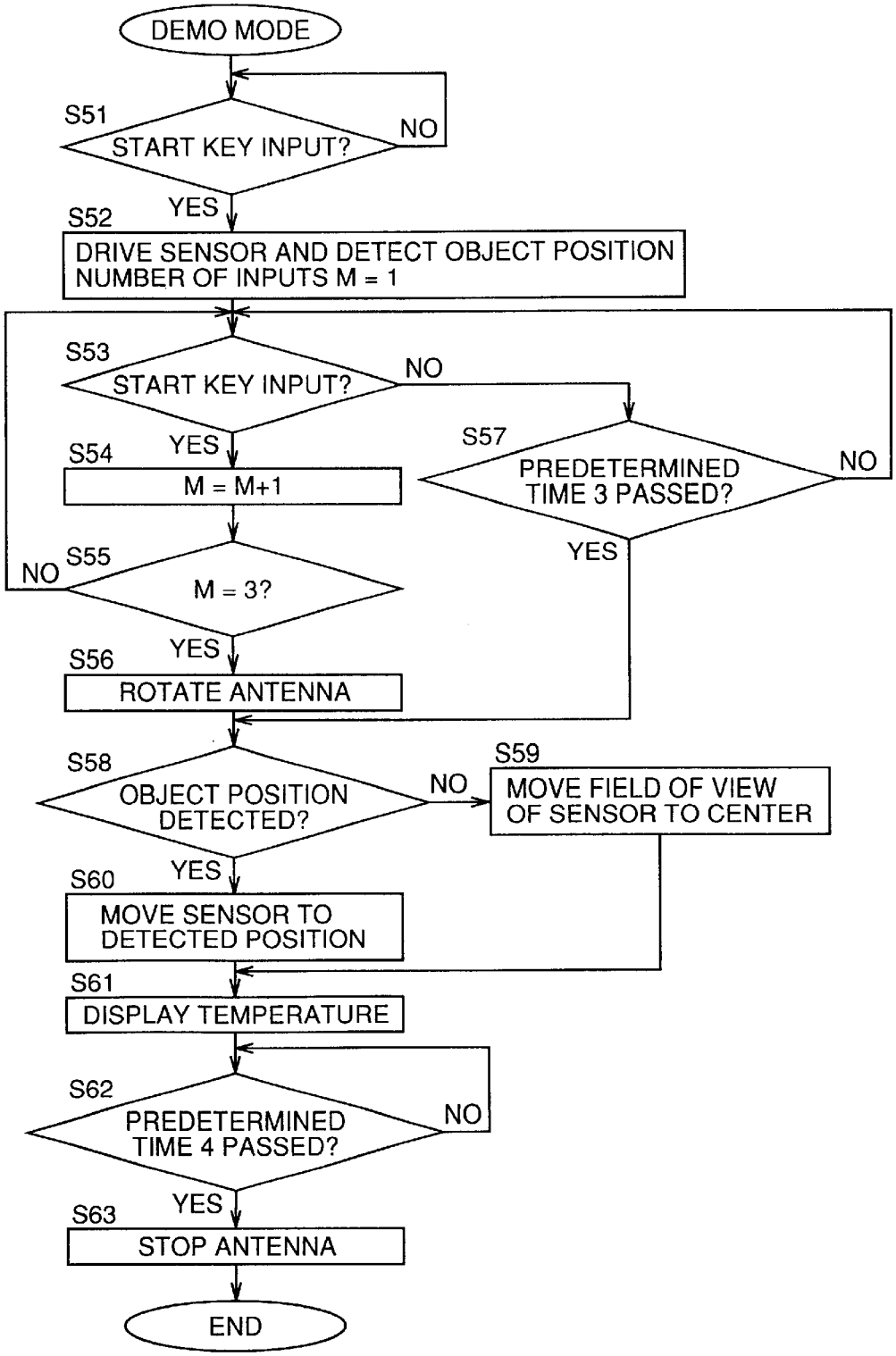
FIG. 17 is a flowchart illustrating a modification of the demo-mode process of FIG. 16.
Figure 18:
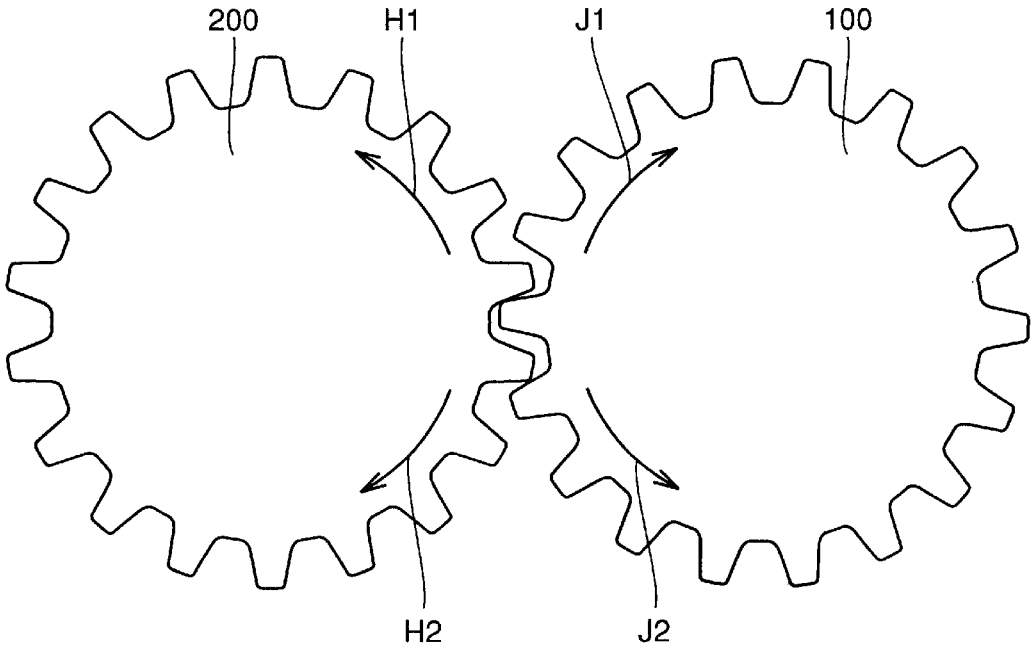
FIG. 18 PRIOR ART
FIG. 18 is a diagram illustrating problems of a mechanism in a conventional microwave oven for moving a field of view of an infrared sensor with a motor.
Figure 19:
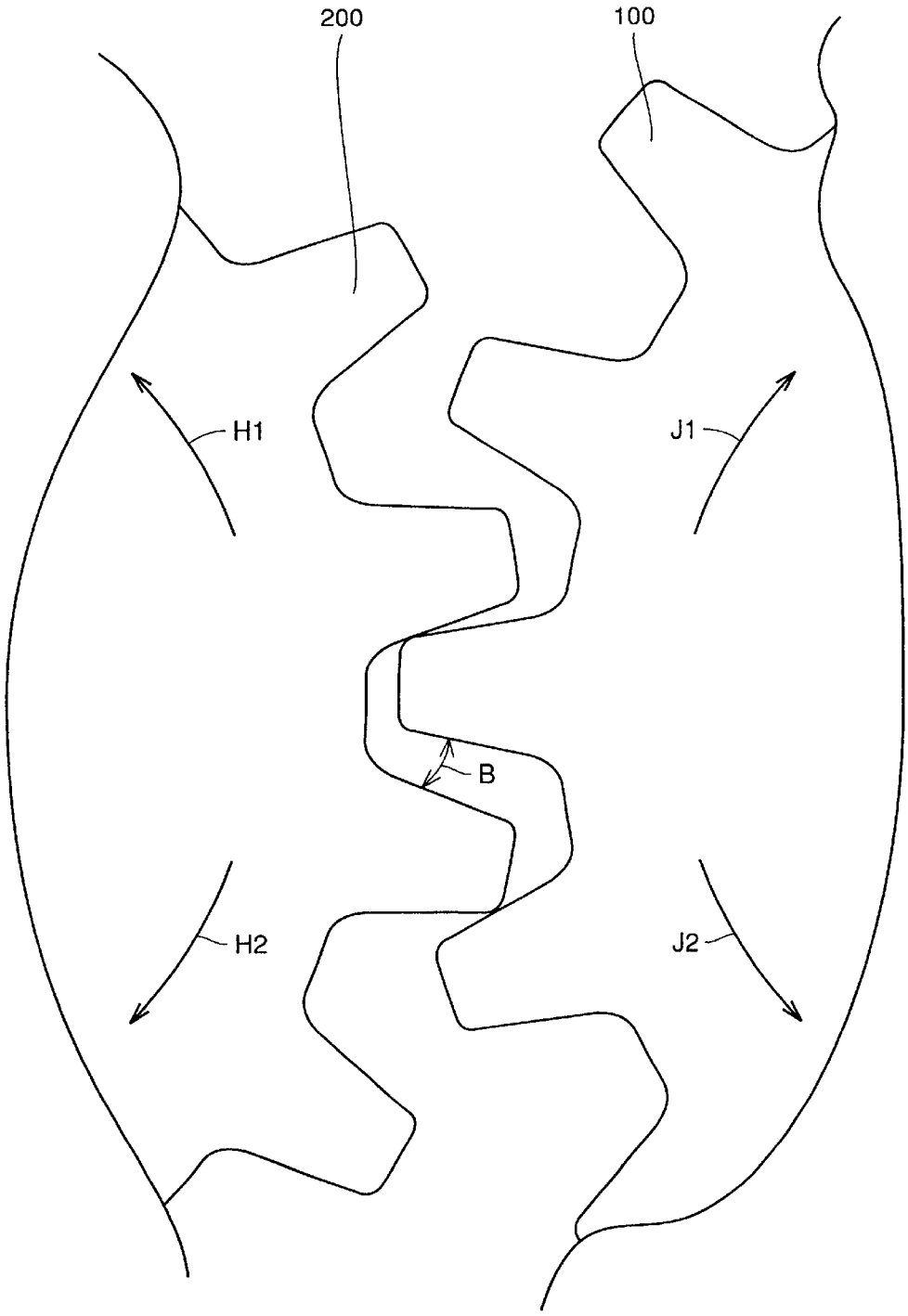
FIG. 19 PRIOR ART
FIG. 19 is a diagram illustrating problems of a mechanism in a conventional microwave oven for moving a field of view of an infrared sensor with a motor.

Note that it is also possible to decide whether or not the demonstration of the rotating antenna 15 is conducted together with the demonstration of the infrared sensor 7, depending on the number of times the start key is pressed. Such a modification of the demo-mode process will be described with reference to FIG. 17. FIG. 17 is a flowchart illustrating the modification of the demo-mode process shown in FIG. 16.

In this modification, if pressing of the start key is detected in S51, the control circuit 30 advances control to S52.

In S52, the control circuit 30 moves the field of view of the infrared sensor 7 within the entire heating chamber 10 in order to detect whether or not the object is placed at any place in the heating chamber 10, and then advances control to S53. Note that, in S52, a count value of a counter M is also incremented to 1. The counter M is a counter for counting the number of times the start key is pressed within a specific time period ("predetermined time 3" as described below).

In S53, the control circuit 30 determines whether or not the start key was pressed again. If it is determined that the start key was pressed again, the control circuit 30 increments the count value of the counter M by one in S54, and then advances control to S55.

In S55, the control circuit 30 determines whether or not the count value of the counter M has reached 3. If it is determined that the count value has not reached 3, the control circuit 30 returns control to S53. If it is determined that the count value has reached 3, the control circuit 30 rotates the rotating antenna 15 in S56, and then advances control to S58.

If it is determined in S53 that start key was not pressed, the control circuit 30 determines in S57 whether or not the "predetermined time 3" has passed since it was determined the start key was pressed in S51. If it is determined that the "predetermined time 3" has not passed, the control circuit 30 returns control to S53. If it is determined that the "predetermined time 3" has passed, the control circuit 30 advances control to S58.

In S58, the control circuit 30 determines whether or not the object was detected at any position in the heating chamber 10 as a result of the scanning of the field of view in S52. This determination is the same as that in S36 (see FIG. 16).

The steps S58 to S63 are the same as the steps S36 to S41, respectively. More specifically, if the object was detected in S58, the field of view of the infrared sensor 7 is moved to the detected position (S60), and the temperature of the object is displayed (S61). If the object was not detected in S58, the field of view of the infrared sensor 7 is moved to the center of the heating chamber 10 (S59), and the temperature at that position is displayed (S61). If the "predetermined time 4" has passed since pressing of the start key was detected in S51 (YES in S62), rotation of the rotating antenna 15 is discontinued (S63), thereby terminating the demo-mode process. Note that, in S63, the count value of the counter M is also cleared.

In the above-described modification shown in FIG. 17, if the start key is pressed once or twice, only the demonstration of the infrared sensor 7 is conducted.

If the start key is pressed three times or more, the respective demonstrations of the infrared sensor 7 and the rotating antenna 15 are conducted. Note that, because of the step S57, the start key must be pressed three times or more within the "predetermined time 3". In other words, in the modification shown in FIG. 17, if the "predetermined time 3" has passed since the first pressing of the start key before the third pressing thereof, the step S58 is conducted without rotating the rotating antenna 15, and the count value of the counter M is cleared in S63.

Although the present invention has been described and illustrated in detail, it is clearly understood that the same is by way of illustration and example only and is not to be taken by way of limitation, the sprit and scope of the present invention being limited only by the terms of the appended claims.

What is claimed is:

1. A microwave oven, comprising:

a heating chamber for accommodating an object;

an infrared sensor having a field of view within the heating chamber, for detecting a temperature of the object in the heating chamber;

a field-of-view moving portion for moving the field of view of the infrared sensor, wherein the field-of-view moving portion moves the field of view in a central region of the heating chamber when temperature detection by the infrared sensor is started in the microwave oven; and a presence determination portion for determining whether or not the object is present within the field of view of the infrared sensor, based on a detection result of the infrared sensor, wherein the field-of-view moving portion extends a movement range of the field of view to a range broader than the central region of the heating chamber, if the presence determination portion determines that the object is not present in the central region of the heating chamber.

2. The microwave oven according to claim 1, wherein the field-of-view moving portion starts moving the field of view when the heating operation of the heating portion is started, and when the field-of-view moving portion extends the movement range of the field of view to the range broader than the central region of the heating chamber, the control portion reduces a heating output of the heating portion from a value that was used during movement of the field of view in the central region of the heating chamber, the reduced heating output being used until the presence determination portion determines that the object is present.

3. The microwave oven according to claim 1, further comprising:

a movement instruction portion for sending the field-of-view moving portion an instruction of whether to move the field of view or not;

a movement determination portion for determining whether the field of view is being moved or not; and a notifying portion for notifying if a determination result of the movement determination portion is different from the instruction sent from the movement instruction-portion to the field-of-view moving portion.

4. The microwave oven according to claim 3, wherein the control portion discontinues the heating operation in response to the notification from the notifying portion.

5. A microwave oven, comprising:

a heating chamber for accommodating an object;

an infrared sensor having a field of view within the heating chamber, for detecting a temperature of the object in the heating chamber;

a field-of-view moving portion for moving the field of view of the infrared sensor, wherein the field-of-view moving portion moves the field of view in a central region of the heating chamber when temperature detection by the infrared sensor is started in the microwave oven, a presence determination portion for determining whether or not the object is present within the field of view of the infrared sensor, based on a detection result of the infrared sensor;

a heating portion for heating the object in the heating chamber; and a control portion for controlling the heating operation of the heating portion, wherein, if the presence determination portion determines that the object is not present in the central region of the heating chamber, the control portion discontinues the heating operation of the heating portion right after the movement of the field of view in the central region of the heating chamber is completed, or after a predetermined time has passed since the movement of the field of view in the central region of the heating chamber is completed.

6. A microwave oven, comprising:

a heating chamber for accommodating an object;

a heating portion for heating the object in the heating chamber;

an infrared sensor having a field of view within the heating chamber, for detecting a temperature of the object in the heating chamber;

a field-of-view moving portion for moving the field of view of the infrared sensor;

a demo executing portion for conducting a demonstration in which the field of view is moved and the infrared sensor is caused to conduct the temperature detection without operating the heating portion;

a presence determination portion for determining whether or not the object is present within the field of view of the infrared sensor, based on a detection result of the infrared sensor, wherein the field-of-view moving portion fixes a position of the field of view to a position of the object as determined by the presence determination portion, and the temperature display portion displays a temperature detected by the infrared sensor with the position of the field of view fixed by the field-of-view moving portion.

7. The microwave oven according to claim 6, wherein the presence determination portion determines that the object is present at a certain position if a temperature detected by the infrared sensor with the field of view moved to the certain position is different at least by a predetermined value from a temperature detected by the infrared sensor with the field of view moved to a position adjacent to the certain position.

8. A method for controlling a microwave oven, wherein a field of view of an infrared sensor is moved in a central region of a heating chamber when the infrared sensor is caused to start temperature detection of an object within the heating chamber;

determining whether or not the object is present within the field of view of the infrared sensor, based on a detection result of the infrared sensor; and determining a position of the object based on both a result of the determination whether or not the object is present within the field of view of the infrared sensor and a position of the field of view of the infrared sensor, wherein if it is determined that the object is not present in the central region of the heating chamber, a movement range of the field of view is extended to a range broader than the central region of the heating chamber.

9. The method according to claim 8, wherein the movement of the field of view of the infrared sensor is started when a heating operation of a heating portion is started, and when the movement range of the field of view of the infrared sensor is extended to the range broader than the central region of the heating chamber, a heating output of the heating portion is reduced from a value that was used during movement of the field of view in the central region of the heating chamber, the reduced heating output being used until it is determined that the object is present.

10. The method according to claim 8, further comprising the steps of:

sending a member for moving the field of view of the infrared sensor an instruction of whether to move the field of view or not;

determining whether the field of view is being moved or not; and notifying if a result of the determination whether the field of view is being moved or not is different from the instruction of whether to move the field of view or not.

11. The method according to claim 10, further comprising the step of:

discontinuing a heating operation of a heating portion if the result of the determination whether the field of view is being moved or not is different from the instruction of whether to move the field of view or not.

12. A method for controlling a microwave oven, wherein a field of view of an infrared sensor is moved in a central region of a heating chamber when the infrared sensor is caused to start temperature detection of an object within the heating chamber, further comprising the steps of:

determining whether or not the object is present within the field of view of the infrared sensor, based on a detection result of the infrared sensor; and determining a position of the object based on both a result of the determination whether or not the object is present within the field of view of the infrared sensor and a position of the field of view of the infrared sensor, wherein if it is determined that the object is not present in the central region of the heating chamber, a heating operation of a heating portion is discontinued right after the movement of the field of view in the central region of the heating chamber is completed, or after a predetermined time has passed since the movement of the field of view in the central region of the heating chamber is completed.

13. A method for controlling a microwave oven in which temperature detection by an infrared sensor is conducted with a field of view of the infrared sensor being moved within a heating chamber, wherein a demonstration of the infrared sensor is conducted by causing the infrared sensor to conduct the temperature detection without conducting a heating operation of a heating portion determining whether or not an object is present within the field of view of the infrared sensor, based on a detection result of the infrared sensor;

fixing a position of the field of view of the infrared sensor to a position of the object determined as being present within the field of view; and displaying a temperature detected by the infrared sensor with the position of the field of view being fixed.

14. The method according to claim 13, wherein in the step of determining whether or not the object is present within the field of view, it is determined that the object is present within the field of view when the field of view is located at a certain position if a temperature detected by the infrared sensor with the field of view moved to the certain position is different at least by a predetermined value from a temperature detected by the infrared sensor with the field of view moved to a position adjacent to the certain position.

* * * * *